US007366448B2

(12) United States Patent
Taniguchi et al.

(10) Patent No.: US 7,366,448 B2
(45) Date of Patent: Apr. 29, 2008

(54) CHARGING MEMBER INCLUDING COATED AND UNCOATED METAL OXIDE PARTICLES

(75) Inventors: Tomohito Taniguchi, Shizuoka-ken (JP); Masaaki Harada, Mishima (JP); Hideyuki Takagi, Mishima (JP); Toshihiro Otaka, Ibaraki-ken (JP); Yoshimasa Sawada, Ushiku (JP)

(73) Assignees: Canon Kabushiki Kaisha, Tokyo (JP); Canon Kasei Kabushiki Kaisha, Tsukuba-shi (JP)

( * ) Notice: Subject to any disclaimer, the term of this patent is extended or adjusted under 35 U.S.C. 154(b) by 5 days.

(21) Appl. No.: 11/156,773

(22) Filed: Jun. 21, 2005

(65) Prior Publication Data

US 2006/0029428 A1 Feb. 9, 2006

(30) Foreign Application Priority Data

Aug. 5, 2004 (JP) ..... 2004-229504
May 27, 2005 (JP) ..... 2005-154894

(51) Int. Cl.
*G03G 15/02* (2006.01)

(52) U.S. Cl. ..... 399/176; 399/174; 430/902

(58) Field of Classification Search ..... 399/176, 399/174, 168; 430/902
See application file for complete search history.

(56) References Cited

U.S. PATENT DOCUMENTS 6,001,454 A 12/1999 Murata et al. ..... 428/141
2003/0219589 A1* 11/2003 Taniguchi et al.

FOREIGN PATENT DOCUMENTS

| | | |
|---|---|---|
| JP | 10-48913 | 2/1998 |
| JP | 2003-162106 | 6/2003 |
| JP | 2004-126064 | 4/2004 |

OTHER PUBLICATIONS

Teitaro Hiraga, et al., *Classification according to composition and crystal form,* Electronic Material Series (Ferrite), Oct. 10, 1997 at 4. (English-language translation).
Yuzo Sanada, et al., *Raw material for industry,* Activated Carbon (Basis and Application), Oct. 20, 1992 at 54-55 (English-language translation and publication information).
Computer Translation of JP 2003-162106.

* cited by examiner

*Primary Examiner*—David M. Gray
*Assistant Examiner*—Laura K. Roth
(74) *Attorney, Agent, or Firm*—Fitzpatrick, Cella, Harper & Scinto

(57) ABSTRACT

A charging member is disclosed having a support and at least one cover layer provided on the support., The cover layer has an outermost layer of the cover layer placed at the outermost surface of the charging member; the outermost layer contains i) composite particles composed of first metal oxide particles coated with carbon black, ii) second metal oxide particles and iii) a binder.

19 Claims, 7 Drawing Sheets

CHARGING MEMBER INCLUDING COATED AND UNCOATED METAL OXIDE PARTICLES

BACKGROUND OF THE INVENTION

1. Field of the Invention

This invention relates to a charging member, and a process cartridge and an electrophotographic apparatus both of which have the charging member.

2. Related Background Art

Image forming apparatus that employ an electrophotographic system, called electrophotographic apparatus, commonly have an electrophotographic photosensitive member, a charging means, an exposure means, a developing means and a transfer means.

In the charging means, a system is primarily employed in which a voltage (a DC voltage only or a voltage created by superimposing an AC voltage on a DC voltage) is applied to a charging member disposed in contact with, or in proximity to, the surface of an electrophotographic photosensitive member, to charge the surface of the electrophotographic photosensitive member electrostatically.

In the case where the voltage created by superimposing an AC voltage on a DC voltage is employed as the voltage applied to the charging member, an AC power source is necessary which requires a large-sized electrophotographic apparatus or brings about an increase in cost, thus a larger power consumption may result, and higher levels of ozone may be produced because of the use of alternating current which will cause a lowering of the durability (running performance) of the charging member or electrophotographic photosensitive member. Accordingly, it is preferable that the voltage to be applied to the charging member is only a DC voltage.

In addition, from the viewpoint of stabilizing charge, reducing ozone generation or achieving low cost, a contact type charging system is preferably used.

In the case of such a contact type charging member, the charging member is kept in contact with the electrophotographic photosensitive member by the pressing force of springs or the like, and is rotated following the rotation of the latter. In many cases, the force by which the charging member is kept in contact with a member to be charged is constant.

After products such as electrophotographic apparatus and what is called the process cartridge in which the main components of the electrophotographic apparatus are integrally held, have been manufactured and before users use them for the first time, there is a possibility that the charging member and the member to be charged will be left standing over a long period of time of from a few weeks up to a few years while the former is kept in contact with the latter by the pressing force of springs or the like. There is also a possibility that, where a user does not use the electrophotographic apparatus, it will be of course left standing for a long term while they are kept in contact with each other. When thus left standing over a long period of time, the charging member is kept in a deformed state at the contact portion between the charging member and the member to be charged, and is not able to return to the original shape thus causing deformation or settling due to compression set, i.e. what is called C-set deformation (hereinafter "C-set").

In recent years, the electrophotographic apparatus is required to achieve much higher process speed, image quality and running performance. Studies made by the present inventors have revealed that such requirements cause the contact zone (C-set areas) to affect images more conspicuously. The C-set areas may appear as horizontal black lines and/or horizontal white lines (C-set images) in the longitudinal direction when, e.g., halftone images are reproduced. This is known to be due to non-uniform charging of the charging member. It has also come to light that the above C-set images tend to occur especially where the voltage applied to the charging member is only a DC voltage.

As a countermeasure against such a problem of C-set, for example, Japanese Patent Application Laid-open No. H10-48913 (Patent Document 1) discloses that an elastic layer is incorporated with a copolymer of ethylene and propylene which contains as a copolymer component a diene component having an iodine value of from 23 to 32, whereby the C-set can be remedied. However, according to studies made by the present inventors, they have come to know that the technique disclosed in Patent Document 1 can not sufficiently remedy the C-set under severer conditions, e.g., under such circumstances that the voltage applied to the charging member is only a DC voltage.

SUMMARY OF THE INVENTION

Accordingly, an object of the present invention is to provide a charging member which can contribute to good image reproduction free of image defects (in particular, C-set images) even when it is used in an electrophotographic apparatus set in a state where it is very difficult to solve the technical problem of C-set, as in the electrophotographic apparatus in which the voltage applied to the charging member is only a DC voltage, and also to provide a process cartridge and an electrophotographic apparatus both of which have such a charging member.

The present invention is directed to a charging member comprising a support and at least one cover layer formed on the support, wherein;

the cover layer has an outermost layer placed at the outermost surface of the charging member; the outermost layer containing i) composite particles comprising first metal oxide particles coated with carbon black, ii) second metal oxide particles and iii) a binder.

The present invention is also a charging member comprising a support and at least one cover layer provided on the support, wherein;

the cover layer has an outermost layer placed at the outermost surface of the charging member; the outermost layer being formed of a matrix comprising a binder, and having a plurality of first segments and a plurality of second segments;

the first segments having a higher affinity with the binder than the second segments;

the first segments being separated from one another by the second segments, and the first segments containing composite particles comprising first metal oxide particles coated with carbon black; and the second segments containing second metal oxide particles.

The present invention also provide a process cartridge and an electrophotographic apparatus both of which have the above charging member.

DESCRIPTION OF THE PREFERRED EMBODIMENTS

The present inventors have made many studies on the problems discussed above. As a result, as a means for keeping the C-set images from occurring, they have found the constitution of a charging member that can simultaneously achieve two points, which are to lessen the level of C-set deformation causative of C-set images and to render C-set areas invisible on images even when they are present. Thus, they have accomplished the present invention.

When incorporated in rubbers, resins, elastomers or the like, carbon black is known to render them conductive and also reinforce them. As in the present invention, when incorporating the outermost layer with composite particles coated with carbon black, carbon black and materials such as rubbers or resins used in the outermost layer are combined strongly with each other, and the strength can be enhanced. According to studies made by the present inventors, however, if the outermost layer is incorporated only with carbon black, the effect of the reinforcement may come too large depending on its quantity, so that the surface of the charging member may have such a high hardness as to cause difficulties such that the charging member comes into faulty contact with the electrophotographic photosensitive member or cannot be suitably rotated and slips. Moreover, any contamination components having remained on the electrophotographic photosensitive member without being transferred to paper or the like tend to be crushed by the charging member, so that contaminants adhere to the charging member surface, resulting in a lowering of durability of the charging member. Such difficulties may also come about. On the other hand, if the carbon black is added in a smaller amount to lower the reinforcement effect, it is difficult to provide the surface layer with desired conductivity. That is, it has not been able to find the addition amount of carbon black that satisfies both the reinforcement effect and conductivity at a high level in the surface layer.

In view of such experimental results, the present inventors have made further many studies. As a result, they have discovered that the outermost layer of the charging member may be so constituted that first segments formed of composite particles comprising first metal oxide particles coated with carbon black and second segments formed of second metal oxide particles are present in a matrix comprising a binder, thereby achieving at a high level both of flexible deformation properties of the outermost layer at the time of application of external force to the outermost layer and restoration properties of the outermost layer at the time of removal of the external force. Thus, they have accomplished the present invention. It is unclear why the flexible deformation properties and the restoration properties can be achieved at a high level by the above constitution, but is presumed below.

Figure 3:
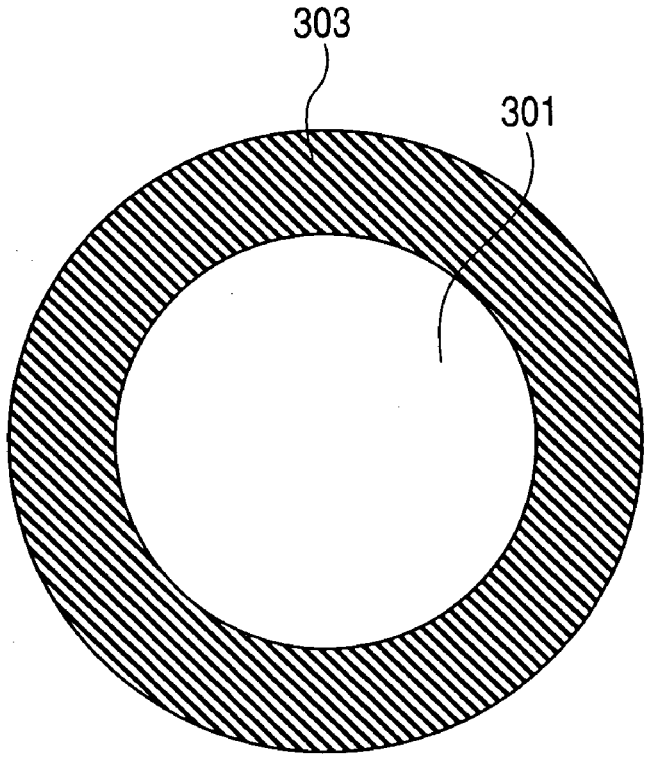
FIG. 3 is a schematic sectional view showing an example of composite particles.
Figure 4:
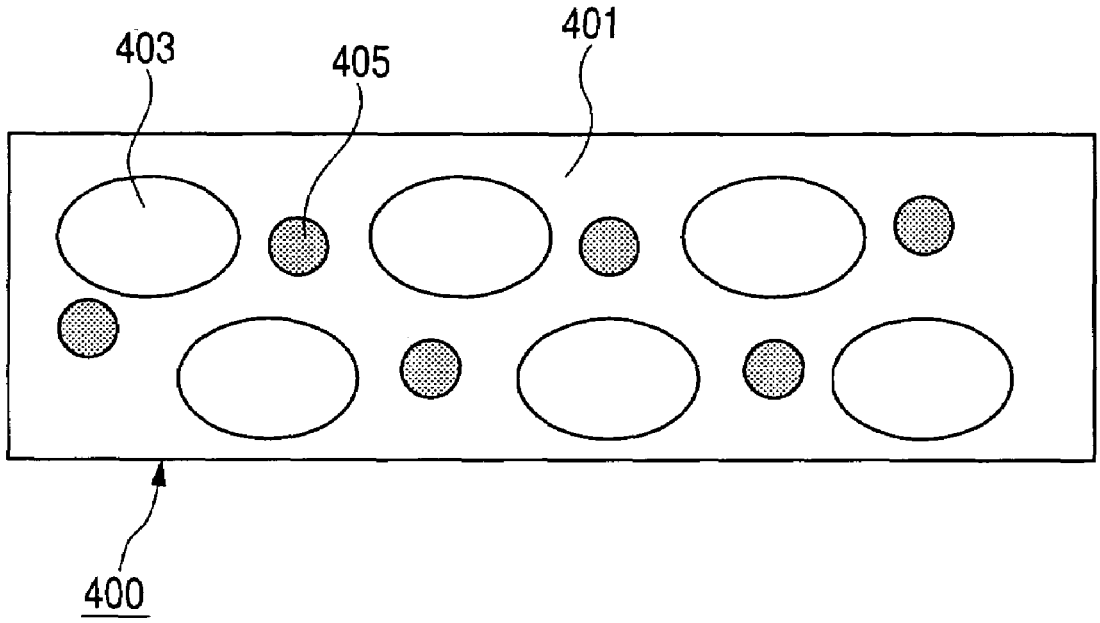
FIG. 4 is a schematic sectional view showing an example of the presence state of composite particles and second metal oxide particles in the outermost layer.

That is, FIG. 4 is a view diagrammatically illustrating a cross section of an outermost layer 400 according to the present invention. In FIG. 4, reference numeral 401 denotes a binder as a matrix; 403, a first segment formed of a composite particle comprised of a first metal oxide particle 301 coated with carbon black 303 as shown in FIG. 3; and 405, a second segment formed of a second metal oxide particle. Then, the first segment 403 chemically combines the first metal oxide particle with the surrounding binder through the carbon black 303. Thus, the position of the first segment in the outermost layer is substantially fixed. On the other hand, the second segment 405 has almost no property of combining with the binder, and hence its position in the outermost layer is relatively rich in freedom. Hence, when external force is applied to the outermost layer, the second segment 405, the position of which is not definitely fixed to the binder because of its low affinity with the binder, changes flexibly in its position in the outermost layer due to the external force applied to the outermost layer, and thereby absorbs the external force. On the other hand, the first segment 403, the relative position of which is stationary to the binder, brings about restoration properties in the outermost layer at the time of removal of the external force from the outermost layer.

For the above reason, the charging member surface is considered to maintain a low hardness and at the same time to lessen the C-set deformation level.

The cross section of the outermost layer in the present invention may be observed on a TEM (transmission electron microscope) photograph of a thin piece prepared by curing a cut piece (inclusive of the outermost layer) of the charging member with an acrylic resin and cutting the cured piece with a microtome.

In addition, charging members containing in their outermost layers particles similar to the composite particles according to the present invention are disclosed in Japanese Patent Applications Laid-open No. 2003-162106 and No. 2004-126064. Specifically, Japanese Patent Application Laid-open No. 2003-162106 proposes a conductive roller which contains composite particles comprising organic polymeric material base particles coated with conductive carbon black. It is described therein that conductive particles are added which comprise base particles with carbon black laid thereon whose base particles are formed of an organic high polymer such as a polyethylene resin or an acrylic resin and have a larger particle diameter than the carbon black, and that carbon black is held on giant particles in that way to prevent the carbon black itself from agglomerating and, in such constitution, the base particles come into contact with each other in the form of beads to form a network, where the carbon black stands dispersed unevenly in a conductive layer, and may be added in a small amount to achieve a high conductivity. However, in the state the carbon black stands dispersed unevenly as in what is disclosed in the above Japanese Patent Application Laid-open No. 2003-162106, it is considered that the outermost layer structure described above which the present invention aims at has not been achieved.

The other publication Japanese Patent Application Laid-open No. 2004-126064 also proposes a conductive member which contains composite particles comprised of inorganic oxide particles surface-covered with surface layers having electron conductivity. However, it has no disclosure as to the incorporation of the second metal oxide particles according to the present invention and the operation and effect to be brought about thereby, and it is considered that the outermost layer structure according to the present invention has not been achieved.

Embodiments of the charging member according to the present invention are described below in greater detail.

As described above, the charging member according to an embodiment of the present invention is a charging member having a cover layer on a support, and the charging member has an outermost layer containing i) composite particles comprising first metal oxide particles coated with carbon black, ii) second metal oxide particles and iii) a binder.

(a) Regarding Composite Particles:

The composite particles in the present invention are particles comprising the first metal oxide particles coated with carbon black as shown in FIG. 3.

That the charging member electrifies the surface of the electrophotographic photosensitive member means that discharge occurs from the charging member to the surface of the electrophotographic photosensitive member causing charge transfer. Where defining as point Y a point at which an extension of a radius of a charging member passing on a certain on the charging member surface intersects the electrophotographic photosensitive member surface, the discharge takes place when a potential difference Vxy between the point X and the point Y exceeds a Paschen's discharge limit voltage (discharge start voltage) Vpa, electric charges ΔQ transfer to the electrophotographic photosensitive member surface, and reverse electric charges −ΔQ transfer to the charging member surface. The total sum of ΔQ corresponds to the electric charges Q accumulated on the surface of the electrophotographic photosensitive member. A potential V of the surface of the electrophotographic photosensitive member may be calculated from the relationship of V=Q/C (C is the electrostatic capacitance of a layer formed on the support of the electrophotographic photosensitive member). Here, the electric charges (density of released electric charges) ΔQ can be calculated from the mathematical expression (1):

$$\Delta Q=\{(Vxh-Vpa)\times(D+G)\}/(D\times G) \quad (1)$$

Figure 13:
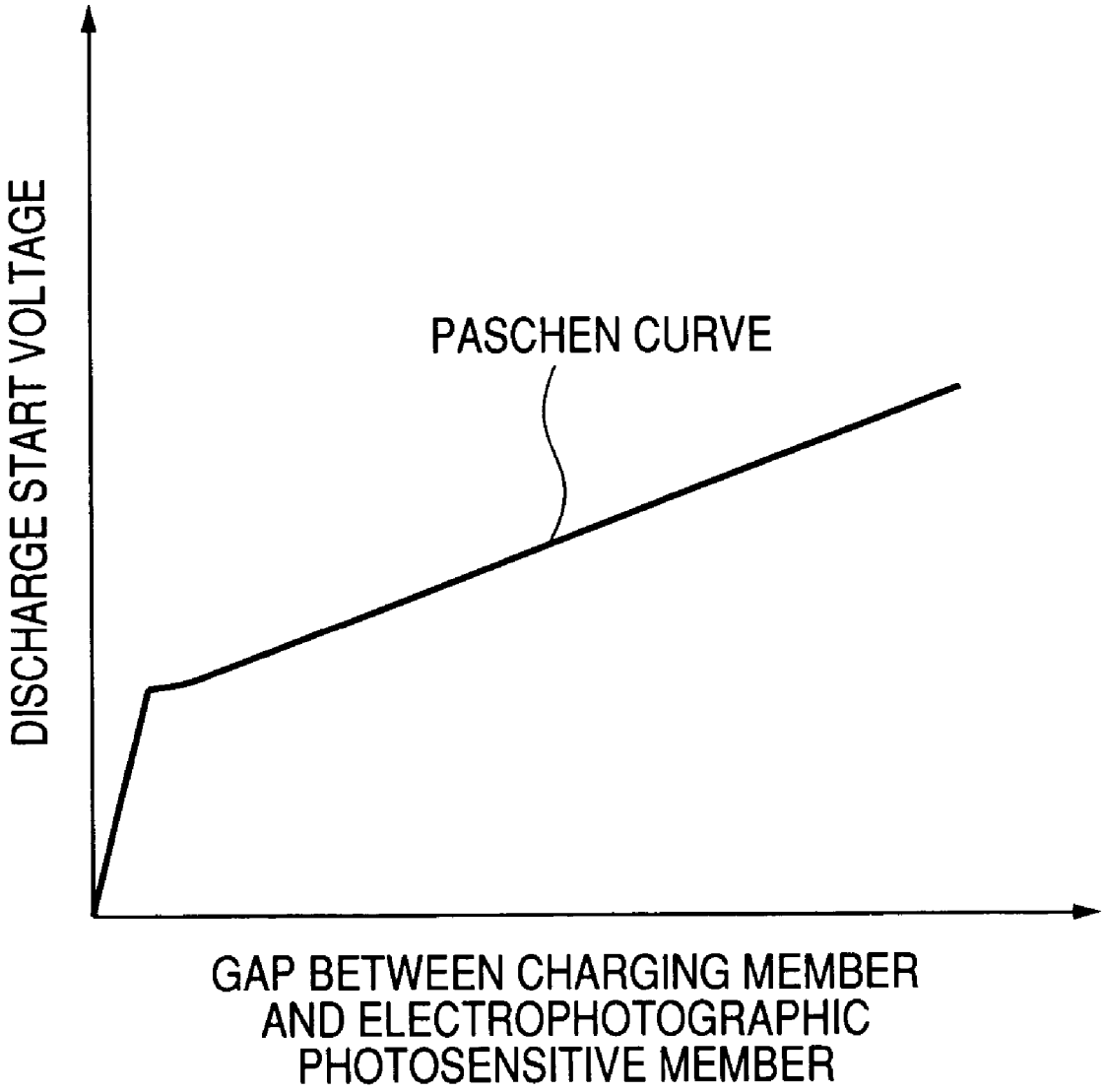
FIG. 13 is a graph which presents the Paschen low.

Letter symbol D in the mathematical expression (1) is $D=\Sigma di/\epsilon i=dc/\epsilon i=dc/\epsilon c+dp/\epsilon p$, where dc is the total (total layer thickness) (m) of the thickness of the layer(s) (one layer or two or more layers) formed on the support of the charging member, dp is the total (total layer thickness) (m) of the thickness of the layer(s) (one layer or two or more layers) formed on the support of the electrophotographic photosensitive member, $\epsilon c$ is the dielectric constant of the layer(s) formed on the support of the charging member, $\epsilon p$ is the dielectric constant of the layer(s) formed on the support of the electrophotographic photosensitive member, G is the distance (gap) (m) between the point X and the point Y, Vxy is the potential difference (V) between the point X and the point Y, and Vpa is the discharge start voltage (V) derived from the mathematical expression (2) and the Paschen's law shown in FIG. 13.

$$\begin{aligned} Vpa &= 7.5\times G\ (0 < G \leqq 4.8\ (\mu m)); \quad (2)\\ &= 360\ (4.8 < G \leqq 7.7\ (\mu m)); \text{ and}\\ &= 312 + 6.2\times G\ (7.7 < G\ (\mu m)) \end{aligned}$$

According to the mathematical expression (1), the electric charges ΔQ transferring due to discharge depend on G, i.e., the gap between the charging member and the electrophotographic photosensitive member. More specifically, it is considered that the deformation at a C-set area inevitably produces a gap difference between the normal charging member surface area and the C-set deformation area to make a difference in the ΔQ, and hence the C-set images (horizontal black lines and/or horizontal white lines) may occur.

Here, according to the mathematical expression (1), it is understood that if the D is reduced, a change in ΔQ with respect to a change in the gap distance G ca be reduced. That is, as for the charging member, if the dielectric constant of the layer formed on the support is increased, it is possible to render the C-set areas invisible on images.

Accordingly, the present invention makes use of the metal oxide particles (first metal oxide particles) in the composite particles in order to obtain the effect of increasing the dielectric constant of the outermost layer.

The dielectric constant is also known to change greatly, depending on the distribution of conductive portions in the layer. Studies made by the present inventors have revealed that if the outermost layer has the structure having segments as described above, it is possible to increase its dielectric constant. In order to perform such structural control, it is necessary for the outermost layer to be further incorporated with second particles in addition to the composite particles. In particular, as the particles, it is preferable to use metal oxide particles as having superior in dispersibility into rubbers, resins, elastomers and so forth.

The composite particles may preferably have an average particle diameter of from 1 nm to 1,000 nm, and more preferably from 5 nm to 500 nm. Within this range, the outermost layer reinforcement effect in the above structure is sufficiently brought about. It is also easy to prevent the dispersibility of composite particles in the outermost layer from deteriorating due to agglomeration among the composite particles.

The composite particles may have any shape of spherical, granular, polygonal, acicular, spindle-like, rice-grain-like, flaky, scaly and plate-like shapes. A spherical or granular shape is preferred in order to more improve the C-set properties.

The first metal oxide particles may be particles of metal oxide or composite metal oxide, and may specifically include particles of zinc oxide, tin oxide, indium oxide, titanium oxide (such as titanium dioxide or titanium monoxide), iron oxide, silica, alumina, magnesium oxide, zirconium oxide, strontium titanate, calcium titanate, magnesium titanate, barium titanate and calcium zirconate. They may more preferably be particles of silica, alumina, titanium oxide, zinc oxide, magnesium oxide, iron oxide, strontium titanate, calcium titanate, magnesium titanate, barium titanate and calcium zirconate.

The shape of the composite particles depends greatly on the particle diameter and shape of the first metal oxide particles. Accordingly, the first metal oxide particles may also preferably have an average particle diameter of from 1 nm to, 1,000 nm, and more preferably from 5 nm to 500 nm.

The first metal oxide particles may have any shape of spherical, granular, polygonal, acicular, spindle-like, rice-grain-like, flaky, scaly and plate-like shapes. A spherical or granular shape is preferred in order to more improve the C-set properties.

As the carbon black with which the first metal oxide particles are coated, furnace black, KETJEN BLACK and channel black are preferably used.

More specifically, it may include granular acetylene black available from Denki Kagaku Kogyo Kabushiki Kaisha; HS-500, ASAHI THERMAL FT, and ASAHI THERMAL MT, available from Asahi Carbon Co., Ltd.; KETJEN BLACK, available from Lion Akzo Co., Ltd.; VULCAN XC-72, REGAL 400R, and MONARCH 1300, available from Cabot Corporation; and COLOR BLACK FW200, SPECIAL BLACK 4, PRINTEX 150T, PRINTEX 140T, and PRINTEX U, available from Degussa Japan Ltd.).

The first metal oxide particles may preferably be those having been surface-treated with a surface treating agent. This enables the carbon black to adhere more strongly to the first metal oxide particle surfaces. Thus, the carbon black can be prevented from, e.g., being liberated when the composite particles are dispersed in rubbers, resins, elastomers or the like, and the effect of improving the C-set properties can be further brought about.

As the surface treating agent, one or two or more of organosilicon compounds may be used, such as alkoxysilanes, fluoroalkylsilanes and polysiloxanes, various coupling agents of a silane type, a titanate type, an aluminate type and a zirconate type, and oligomers or polymeric compounds. It is more preferable to use organosilicon compounds such as alkoxysilanes and polysiloxanes, and various coupling agents of a silane type, a titanate type, an aluminate type and a zirconate type, and still more preferable to use organosilicon compounds.

Such organosilicon compounds may be exemplified by an alkoxysilane represented by the formula (1), an organosilane compound produced from the alkoxysilane, a polysiloxane represented by the formula (2), a modified polysiloxane represented by the formula (3), a terminal-modified polysiloxane represented by the formula (4), a fluoroalkylsilane represented by the formula (5), and a mixture of any of these.

$$R_a—Si—X_{4-a} \quad (1)$$

a: an integer of 1 to 3

X: $—OCH_3$, $—OC_2H_5$, —Cl

R: $—C_6H_5$, $—C(R_1)(R_2)(R_3)$ $R_1$, $R_2$, $R_3$: $—C_mH_{2m+1}$, $—C_6H_5$ m: an integer of 0 to 18

The alkoxysilane may specifically include methyltriethoxysilane, dimethyldiethoxysilane, phenyltriethoxysilane, diphenyldiethoxysilane, dimethyldimethoxysilane, methyltrimethoxysilane, phenyltrimethoxysilane, diphenyldimethoxysilane, isobutyltrimethoxysilane and decyltrimethoxysilane.

Taking into account the adhesion strength of the carbon black to the first metal oxide particles, it is more preferred to use alkoxysilanes such as methyltriethoxysilane, methyltrimethoxysilane, dimethyldimethoxysilane, isobutyltrimethoxysilane and phenyltriethoxysilane, or organosilane compounds produced from the alkoxysilanes.

(2)

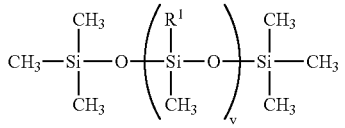

$R^1$: —H, $—CH_3$
v: 15~450

(3)

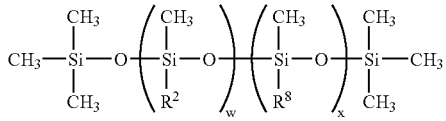

$R^2$: $R^3—O—(CH_2—CH(R^4)—O)_q—R^5$, $R^3—O—(C(=O)—R^6—C(=O)—O—R^7—O)_p—R^5$, $R^3—O—CH_2—CH(\text{epoxide})—CH_2$ $R^3$, $R^6$, $R^7$: $—(CH_2)_l—$ ($R^3$, $R^6$, and $R^7$ may be the same or different.)

$R^4$, $R^8$: $—(CH_2)_m—CH_3$ $R^5$: OH, COOH, $—CH=CH_2$, $—C≡CH_3$, $—(CH_2)_n—CH_3$ l: 1~15
m, n: 0~15
w: 1~50
x: 1~300
p: 1~10
q: 1~10

(4)

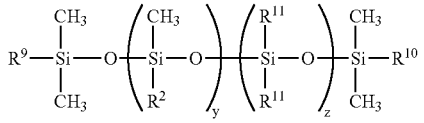

$R^9$, $R^{10}$: —OH, $R^{12}OH$, $R^{13}COOH$, ($R^9$ and $R^{10}$ may be the same or different.)
$R^{11}$: $—CH_3$, $—C_6H_5$
$R^{12}$, $R^{13}$: $—(CH_2)_p—$
p: 1~15
y: 1~200
z: 0~100

The polysiloxane may include polysiloxanes having a methylhydrogensiloxane unit, polyether modified polysiloxanes, and terminal carboxylic acid modified polysiloxanes, modified with a carboxylic acid(s) at a terminal(s).

The fluoroalkylsilane may specifically include trifluoropropyltrimethoxysilane, tridecafluorooctyltrimethoxysilane, heptadecafluorodecyltrimethoxysilane, heptadecafluorodecylmethyldimethoxysilane, trifluoropropylethoxysilane, tridecafluorooctyltriethoxysilane and heptadecafluorodecyltriethoxysilane.

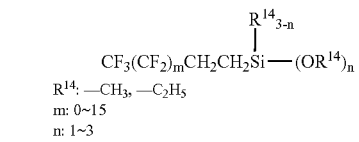

(5)

$R^{14}$: $—CH_3$, $—C_2H_5$
m: 0~15
n: 1~3

As for the coupling agents, the silane type coupling agent may include vinyltrimethoxysilane, vinyltriethoxysilane, γ-aminopropyltriethoxysilane, γ-glycidoxypropyltrimethoxysilane, γ-mercaptopropyltrimethoxysilane, γ-methacryloxypropyltrimethoxysilane, N-β-(aminoethyl)-γ-aminopropyltrimethoxysilane, γ-glycidoxypropylmethyldimethoxysilane and γ-chloropropyltrimethoxysilane.

The titanate coupling agent may include isopropyltristearoyl titanate, isopropyltri(dioctyl pyrophosphate) titanate, isopropyltri(N-aminoethyl aminoethyl) titanate, tetraoctylbis(ditridecyl phosphate) titanate, tetra(2,2-diallyloxymethyl-1-butyl)bis(ditridecyl) phosphate titanate, bis(dicotyl pyrophosphate) oxyacetate titanate, and bis(dicotyl pyrophosphate) ethylene titanate.

The aluminate type coupling agent may include acetoalkoxyaluminum diisopropylate, aluminum diisopropoxymonoethyl acetoacetate, aluminum trisethyl acetoacetate, and aluminum trisacetyl acetonate.

The zirconate type coupling agent may include zirconium tetrakisacetyl acetonate, zirconium dibutoxybisacetyl acetonate, zirconium tetrakisethyl acetoacetate, zirconium tributoxymonoethyl acetoacetate, and zirconium tributoxyacetyl acetonate.

As the oligomers, those having a molecular weight of from 300 or more to less than 10,000 are preferable. As the polymeric compounds, those having a molecular weight of from 10,000 or more to about 100,000 are preferable. Taking into account uniform coat treatment on the first metal oxide particles, oligomers or polymeric compounds which are liquid, or soluble in water or various solvents are preferable.

The surface treating agent may preferably be in a coat weight (coverage) of from 0.01 to 15.0% by weight based on the weight of the first metal oxide particles. If it is less than 0.01% by weight, it may be difficult to adhere the carbon black to the first metal oxide particles. If it is in a coat weight of 15.0% by weight, the carbon black can be adhered strongly to the first metal oxide particles and in a sufficient quantity, and hence it is meaningless to coat the first metal oxide particles in a coat weight of more than that. It may more preferably be in a coat weight of from 0.02 to 12.5% by weight, and most preferably from 0.03 to 10.0% by weight.

The volume resistivity of the composite particles in the present invention may arbitrarily be controlled to a value intermediate between the volume resistivity of the carbon black used in adhering to the first metal oxide particles and the volume resistivity of the first metal oxide particles. Specifically, it may be from $1.0\times10$ to $1.0\times10^8$ Ωcm, and preferably from $5.0\times10$ to $5.0\times10^7$ Ωcm.

The carbon black may be adhered to the first metal oxide particles in a weight of from 1 to 500 parts by weight based on 100 parts by weight of the latter. If it is in a weight of less than 1 part by weight, it is difficult for the resultant composite particles to have a low electrical resistance. If it is in a weight of more than 500 parts by weight, the effect of lowering the electrical resistance can sufficiently be exhibited, and hence it is meaningless to adhere the carbon black in a weight of more than 500 parts by weight.

The composite particles may be obtained by mixing the first metal oxide particles and the carbon black. The carbon black may be adhered to the first metal oxide particles by first surface-treating the first metal oxide particles and then mixing the surface-treated first metal oxide particles and the carbon black.

The surface treatment of the first metal oxide particles may be carried out by mechanically mixing and agitating the first metal oxide particles and the surface treating agent or a solution of the surface treating agent, or by mechanically mixing and agitating the first metal oxide particles and the surface treating agent or a solution of the surface treating agent while the latter is sprayed on the former.

In addition, where the alkoxysilane or fluoroalkylsilane is used as the surface treating agent, part of the alkoxysilane or fluoroalkylsilane may be applied as an organosilane compound formed from the alkoxysilane or a fluorine-containing organosilane compound formed from the fluoroalkylsilane as a result of going through the coating step. In such a case as well, the subsequent adhesion of carbon black is by no means affected. In order for the surfaces of the first metal oxide particles to be uniformly coated with the surface treating agent, it is preferable to beforehand disintegrate agglomerates of the first metal oxide particles by means of a grinding machine.

As machinery for mixing and agitating the first metal oxide particles and the carbon black, the surface-treated first metal oxide particles and the carbon black, and the first metal oxide particles and the surface treating agent, an apparatus capable of applying shear force to powder layers is preferred. In particular, apparatus are usable which can carry out shearing, spatulation and compression simultaneously, as exemplified by a wheel type kneading machine, a ball type kneading machine, a blade type kneading machine and a roll type kneading machine. The wheel type kneading machine is more effectively usable. Also, after the mixing and agitation, drying or heat treatment may optionally be carried out.

Further, with regard to the surface treatment of the first metal oxide particles, a method is available in which the first metal oxide particles and the surface treating agent are mixed and dispersed in a suitable solvent to adhere the surface treating agent to particle surfaces. As a means for such dispersion, conventionally known fluid dispersing means such as a ball mill, a sand mill, a paint shaker, Daino mill and Pearl mill are usable. Next, the solvent is removed from the resultant fluid dispersion to allow the surface treating agent to stick to particle surfaces. Thereafter, heat treatment may further optionally be carried out. In addition, a catalyst for accelerating the reaction may be added to the fluid mixture. Further, the particles having been surface-treated may optionally be subjected to pulverization.

The first metal oxide particles may be those the particle surfaces of which have previously been coated with an intermediate coat material consisting of at least one selected from a hydroxide of aluminum, an oxide of aluminum, a hydroxide of silicon and an oxide of silicon. This is because there are cases in which the adhesive force between the first metal oxide particles and the carbon black can thereby be made stronger.

Such an intermediate coat material may preferably be in a coat weight (coverage) of from 0.01 to 20% by weight. If it is in a coat weight of less than 0.01% by weight, the effect of improving the adhesion of carbon black is not obtainable in some cases. Even if it is in a coat weight of more than 20% by weight, the effect of further improving the adhesion of carbon black is not obtainable, and hence it is meaningless to be in a coat weight of more than that.

(b) Regarding Second Metal Oxide Particles:

Subsequently, the second metal oxide particles are described. The same metal oxide particles as the first metal oxide particles may be used as the second metal oxide particles.

The second metal oxide particles may preferably have an average particle diameter of from 1 nm to 1,000 nm, and more preferably from 5 nm to 500 nm. Within this range, the outermost layer reinforcement effect due to the above structure can sufficiently be brought about. Also, the second metal oxide particles can be kept from agglomerating, and their dispersibility in the binder in the outermost layer can be suitably controlled.

The second metal oxide particles may preferably be those having been surface-treated. The surface treatment may include, in addition to the same surface treatment as that for the first metal oxide particles described above, surface treatment with a fatty acid or a fatty acid metal salt.

As the fatty acid, any of saturated or unsaturated fatty acids may be used, and those having 12 to 22 carbon atoms are preferred. As the fatty acid metal salt, salts of saturated or unsaturated fatty acids with metals are usable, which may include salts of fatty acids having 12 to 22 carbon atoms with alkaline earth metals such as magnesium, calcium, strontium and barium, alkali metals such as lithium, sodium and potassium, or metals such as zinc, aluminum, copper, iron, lead and tin.

The surface treatment of the metal oxide particles in the present invention may preferably be surface treatment with an organosilicon compound such as an alkoxysilane or a polysiloxane. This is because such a compound is suitably adherent to the metal oxide particle surfaces, and at the same time effective in improving the dispersibility of the metal oxide particles in rubbers, resins, elastomers or the like. In addition, by using the compound similar to the surface treating agent used in the composite particles, it is facilitated that the second metal oxide particles are dispersed to exist among the composite particles.

The surface treating agent may preferably be in a coat weight (coverage) of from 0.01 to 15.0% by weight. Within this range, it can provide the second metal oxide particles with sufficient dispersibility. It may more preferably in a coat weight of from 0.02 to 12.5% by weight, and most preferably from 0.03 to 10.0% by weight.

The second metal oxide particles may preferably have a dielectric constant of 30 or more. This is because it is preferable to increase the dielectric constant of the outermost layer as described previously. Accordingly, it is more preferable to select the second metal oxide particles from particles of titanium oxide, strontium titanate, calcium titanate and barium titanate.

The second metal oxide particles may be surface-treated by the same methods as those for the first metal oxide particles described previously.

Of such methods, the method in which mixing and dispersion are effected in the solvent is particularly preferable. This method enables strong and uniform treatment of the second metal oxide particle surfaces to be strongly and uniformly treated, and can greatly improve the dispersibility of the second metal oxide particles, making it easy to achieve the outermost layer structure described above which the present invention aims at.

Any one or both of the first and second metal oxide particles may preferably be insulating particles. Herein, the insulating particles refer to those having a volume resistivity of more than $1\times10^8$ Ωcm. Inasmuch as the metal oxide particles are insulating, the conductive paths in virtue of the carbon black can be controlled, and a higher dielectric constant can be established in the outermost layer structure which the present invention aims at.

The composite particles and second metal oxide particles in the outermost layer may preferably be in a weight ratio (composite particles/second metal oxide particles) of from 0.01 to 100, more preferably from 0.1 to 50, still more preferably from 0.2 to 15, and particularly preferably from 0.2 to 3.9. Within this range, it is easy to achieve the outermost layer structure which the present invention aims at, and a high effect can be brought about against the C-set images.

A proportion of the total weight of the composite particles and second metal oxide particles in the outermost layer to the outermost layer binder may preferably be from 5 to 200% by weight, and more preferably from 10 to 150% by weight. Within this range, it is easy to achieve the outermost layer structure which the present invention aims at, and a high effect can be brought about against the C-set images.

(c) Regarding Charging Member:

(c-1) Layer Structure:

The charging member of the present invention comprises a support and provided thereon at least one cover layer.

As the cover layer, any of layers may be employed which are conventionally known and have variety of structures, including layers formed of, e.g., resins, rubbers (natural rubbers, which may be subjected to vulcanization treatment, or synthetic rubbers) and elastomers such as thermoplastic elastomers, used as binding materials.

The resins may include fluorine resins, polyamide resins, acrylic resins, polyurethane resins, silicone resins, butyral resins, a styrene-ethylene butylene-olefin copolymer (SEBC) and an olefin-ethylene butylene-olefin copolymer (CEBC).

The synthetic rubbers may include an ethylene-propylene-diene copolymer (EPDM), styrene-butadiene copolymer rubber (SBR), silicone rubbers, urethane rubbers, isoprene rubber (IR), butyl rubber (BR), acrylonitrile-butadiene copolymer rubber (NBR), chloroprene rubber (CR), acrylic rubbers and epichlorohydrin rubbers.

The thermoplastic elastomers may include polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene vinyl acetate type thermoplastic elastomers, polyvinyl chloride type thermoplastic elastomers, and chlorinated polyethylene type thermoplastic elastomers.

Any of the above may be used alone, or in the form of a mixture or a copolymer.

In the charging member of the present invention, two or more cover layers may be provided on the support.

As the support of the charging member, it may at least have conductivity (conductive support). For example, a support made of a metal (or made of an alloy) such as iron, copper, stainless steel, aluminum or nickel may be used. Also, for the purpose of providing scratch resistance, plating or the like may be applied to the surface of any of these supports as long as its conductivity is not impaired.

Where the charging member is used in the state it is disposed in contact with the electrophotographic photosensitive member, a cover layer having conductivity and elasticity (hereinafter also "elastic cover layer") may preferably be provided between a cover layer serving as the outermost layer (hereinafter also "surface cover layer") and the support, from the viewpoint of improving the supply of electricity to that electrophotographic photosensitive member and establishing uniform close contact between that electrophotographic photosensitive member and the charging member.

Examples of the layer structure of the charging member are shown in FIGS. 5 to 12.

Figure 5:
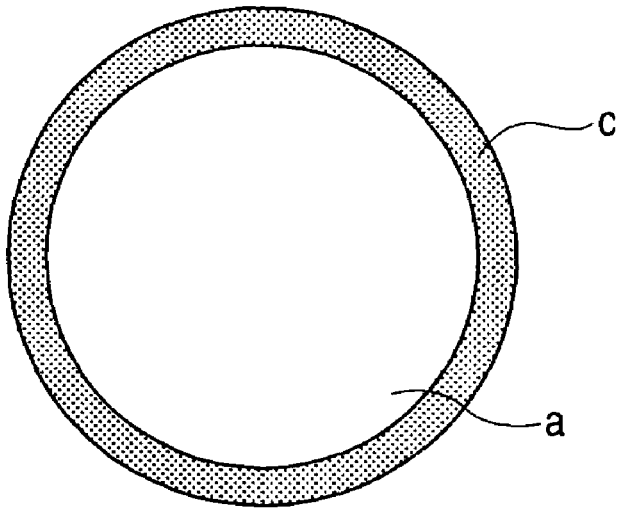
FIG. 5 is a view showing an example of the layer structure of a roller-shaped charging member.

The charging member shown in FIG. 5 is a roller-shaped charging member, and is of a single-layer structure, having a support a, and a surface cover layer c formed on the support a.

Figure 6:
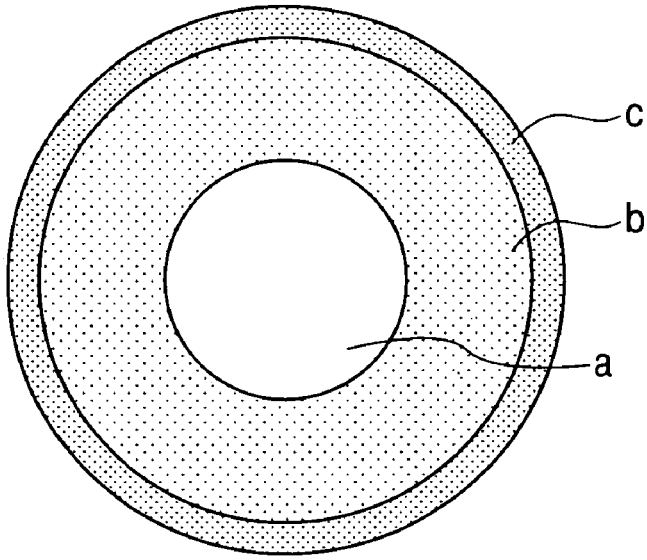
FIG. 6 is a view showing another example of the layer structure of a roller-shaped charging member.

The charging member shown in FIG. 6 is a roller-shaped charging member, and is of a double-layer structure, having a support a, an elastic cover layer b formed on the support a, and a surface cover layer c formed on the elastic cover layer b.

Figure 7:
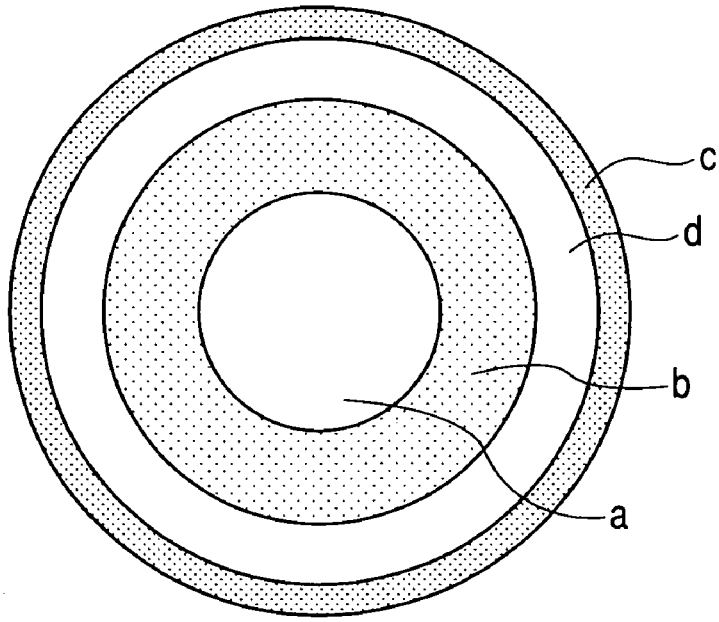
FIG. 7 is a view showing still another example of the layer structure of a roller-shaped charging member.

The charging member shown in FIG. 7 is a roller-shaped charging member, and is of a triple-layer structure, provided with a resistance layer (a kind of cover layer) d between the elastic cover layer b and the surface cover layer c of the charging member shown in FIG. 6.

Figure 8:
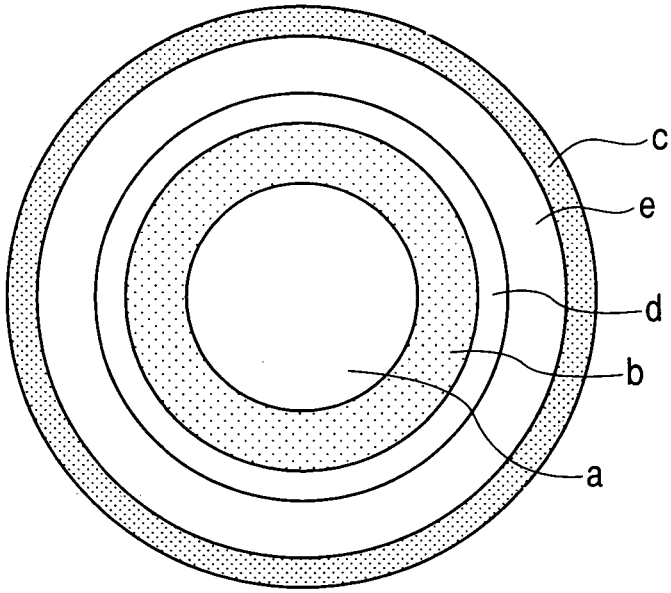
FIG. 8 is a view showing a further example of the layer structure of a roller-shaped charging member.
Figure 9:
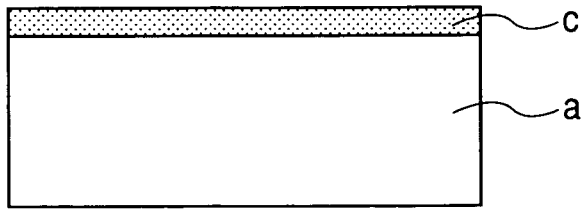
FIG. 9 is a view showing an example of the layer structure of a charging member.
Figure 10:
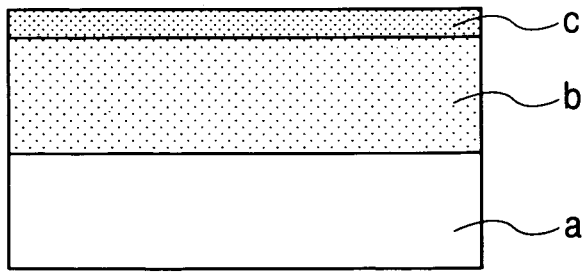
FIG. 10 is a view showing another example of the layer structure of a charging member.
Figure 11:
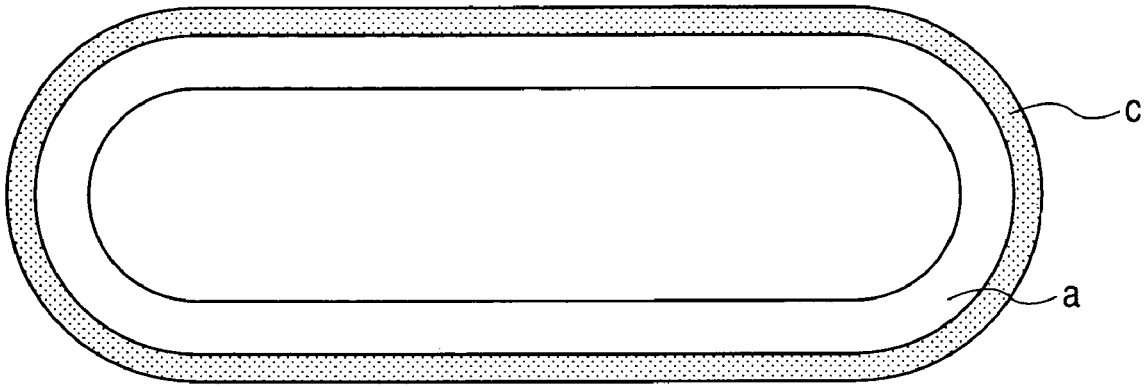
FIG. 11 is a view showing an example of the layer structure of a belt-shaped charging member.
Figure 12:
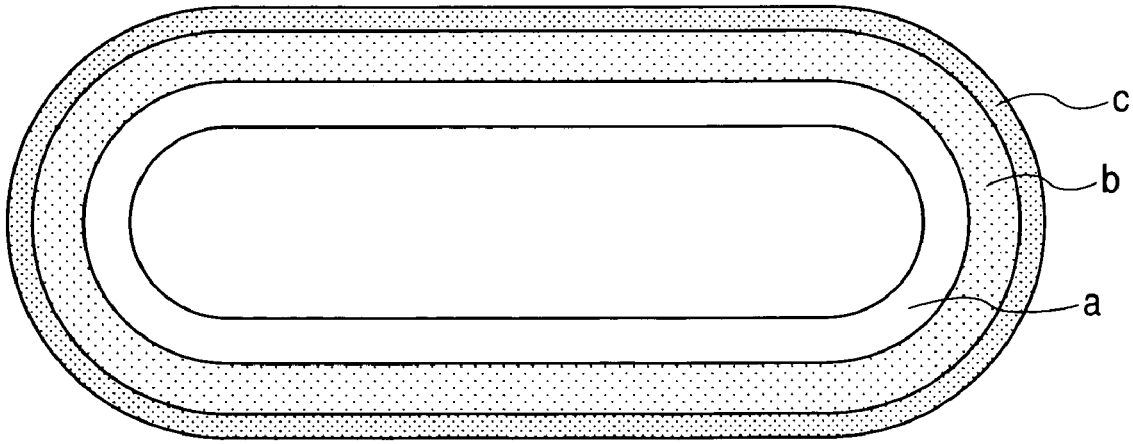
FIG. 12 is a view showing another example of the layer structure of a belt-shaped charging member.

The charging member shown in FIG. 8 is a roller-shaped charging member, and is of a four-layer structure, provided with a second resistance layer (a kind of cover layer) between the resistance layer d and the surface cover layer c of the charging member shown in FIG. 7.

In addition, the charging member of the present invention may preferably have the shape of a roller, but may have various shapes such as, as exemplified in FIGS. 9 to 12, the shape of a sheet, the shape of a belt, the shape of a film and the shape of a plate, which may each also have the layer structure described above. In the following, the roller-shaped charging member is called "charging roller".

The roller-shaped charging member, i.e., the charging roller may be formed in what is called a crown shape, a shape in which the roller is thickest at the middle in its lengthwise direction and is thinner toward both ends in the lengthwise direction. This is preferable from the viewpoint of establishing uniform close contact between the charging roller and the electrophotographic photosensitive member. The charging roller commonly comes into contact with the electrophotographic photosensitive member in the state that given pressing force is applied to both ends of the support, where the pressing force is small at the middle in the lengthwise direction and becomes larger toward both ends in the lengthwise direction. Hence, density non-uniformity may occur between images corresponding to the middle and images corresponding to both ends. The crown shape is formed in order to prevent such density non-uniformity. As a crown level, the difference between an external diameter at the middle portion and external diameters at positions 90 mm away from the middle portion may preferably be from 30 μm to 200 μm. If it is smaller than 30 μm, a state is apt to come about in which the roller comes in contact at the end portions and not at the middle portion. If it is larger than 200 μm, in reverse a state is apt to come about in which the roller comes in contact at the middle portion but not at the end portions.

In the case where the charging member is used in the state it is disposed in contact with the electrophotographic photosensitive member or other members, a material having a high releasability may preferably be used in the surface cover layer so that the charging member may not contaminate the electrophotographic photosensitive member and other members. From such a viewpoint, a resin may preferably be used as a binding material of the surface cover layer.

(c-2) Regarding Other Particles the Outermost Layer May Contain:

In the present invention, in addition to the above composite particles and second metal oxide particles, the surface cover layer (outermost layer) may also contain other additional particles in such an extent that the effect to be brought about by the present invention is not impaired.

The additional particles that may be incorporated in the surface cover layer are roughly grouped into conductive particles and insulating particles. In the present invention, the "conductive particles" are meant to be particles having a volume resistivity of $1\times10^8$ Ωcm or less, and the "insulating particles" are meant to be particles having a volume resistivity of more than $1\times10^8$ Ωcm.

The conductive particles may include, e.g., particles of carbon black, tin oxide, titanium oxide, zinc oxide, barium sulfate, copper, aluminum or nickel.

The insulating particles may include, e.g., particles of high-molecular compounds, as exemplified by particles of resins such as polyamide resins, silicone resins, fluorine resins, acrylic or methacrylic resins, styrene resins, phenol resins, polyester resins, melamine resins, urethane resins, olefin resins, epoxy resins, and copolymers, modified products or derivatives of these; particles of rubbers such as an ethylene-propylene-diene copolymer (EPDM), styrene-butadiene copolymer rubber (SBR), silicone rubbers, urethane rubbers, isoprene rubber (IR), butyl rubber (BR), acrylonitrile-butadiene copolymer rubber (NBR), chloroprene rubber (CR) and epichlorohydrin rubbers; and particles of thermoplastic elastomers such as polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene vinyl acetate type thermoplastic elastomers, polyvinyl chloride type thermoplastic elastomers, and chlorinated polyethylene type thermoplastic elastomers.

Other insulating particles may include particles of barium sulfate, molybdenum disulfide, calcium carbonate, magnesium carbonate, dolomite, talc, kaolin clay, mica, aluminum hydroxide, magnesium hydroxide, zeolite, wollastonite, diatomaceous earth, glass beads, bentonite, montmorillonite, asbestos, hollow glass balloons, graphite, rice hull, organometallic compounds, and organometallic salts. Also particles of iron oxides such as ferrite, magnetite and hematite, and activated carbon are usable. As the ferrite, it may include, e.g., ferrite described in "Electronic Material Series, Ferrite" (Maruzen Co., Ltd.; published Oct. 10, 1997, Fifth Edition). Specifically, $MnFe_2O_4$, $Fe_2O_4$, $ZnFe_2O$, $MgFe_2O_4$ and $\gamma$—$Fe_2O_4$ may be exemplified. The activated carbon may include activated carbon described in "New Edition, Activated Carbon—Basis and Application" (Kodansha Ltd.; published Oct. 20, 1992, Second Edition). Specifically, wood activated carbon, coconut shell activated carbon, and coal activated carbon may be exemplified.

Any of these particles may be used alone or in combination, and may be those having been surface-treated, modified, functional-group- or molecular-chain-introduced, or coated. In order to improve the dispersibility of particles, the particles may preferably be subjected to surface treatment. In such a case, as the surface treatment of particles, the surface treatment methods may be used which have been described in respect of the above first metal oxide particles and/or second metal oxide particles.

(c-3) Regarding Physical Properties of Outermost Layer:

The surface cover layer (outermost layer) may preferably have a volume resistivity of $10^2$ Ωcm or more to $10^{16}$ Ωcm or less in an environment of 23° C./50% RH. If the surface cover layer has a volume resistivity above this range, difficulties may come about such that the charging ability required for the charging member may lower to tend to cause C-set images more conspicuously or that the ability to perform uniform charging (charging uniformity) may lower. If on the other hand the surface cover layer has a volume resistivity below the above range, it may be difficult to prevent leakage due to pinholes or scratches of the surface of the electrophotographic photosensitive member, the member to be charged.

In order to improve the releasability of the surface of the charging member, a release agent may also be incorporated in the surface cover layer. Incorporation of the release agent in the surface cover layer can reduce of any adhesion of dirt to the surface of the charging member, and hence brings an improvement in durability (running performance) of the charging member. Such incorporation can smoothen relative movement smooth between the charging member and the electrophotographic photosensitive member, and hence lessen any state of irregular movement such as stick slip less occur, so that any irregular wear of the surface of the charging member, noise (abnormal sound) and so forth can be kept from occurring. In addition, where the release agent incorporated in the surface cover layer is a liquid, it acts also as a leveling agent when the surface cover layer is formed.

Many release agents are those utilizing low surface energy and those utilizing slidability, and their states are liquid or solid. As those having slidability in solid form (solid lubricants), the following are usable, e.g., substances described in Solid Lubricant Handbook (publisher: K.K. Saiwai Shobo Co.; published Mar. 15, 1982, Second Edition), which are specifically metal oxides such as graphite, graphite fluoride, molybdenum disulfide, tungsten disulfide, boron nitride and lead monoxide.

Compounds containing silicon or fluorine in their molecules may be used in an oil form or a solid form (releasing resin or powder, or a polymer into part of which a moiety having releasability has been introduced). The release agent may further include waxes and higher fatty acids (inclusive of salts or esters and other derivatives thereof).

(c-4) Regarding Elastic Layer:

The elastic cover layer is, as mentioned above, a cover layer having conductivity and elasticity.

In order to provide the elastic cover layer with elasticity, it is preferable to use as a binding material an elastomer such as a rubber or a thermoplastic elastomer. In particular, from the viewpoint of securing a sufficient nip between the charging member and the electrophotographic photosensitive member, it is more preferable to use a rubber, in particular, a synthetic rubber.

Of the synthetic rubber, from the viewpoint of uniformity in resistance, it is preferable to use a polar rubber. The polar rubber may include NBR and epichlorohydrin rubbers.

With regard to the epichlorohydrin rubber, it is known that in GECO (ethylene oxide (hereinafter also "EO")—epichlorohydrin (hereinafter also "EP")—acrylglycidyl ether (hereinafter also "AGE") copolymer) or ECO (ethylele oxide-epichlorohydrin copolymer), the copolymerization ratio of the EO may be changed to control the volume resistivity.

In the present invention, the elastic cover layer may also preferably have a volume resistivity of from $10^2$ to $10^8$ Ωcm in an environment of 23° C./50% RH. If the elastic cover layer has a volume resistivity of more than $10^8$ Ωcm, a difficulty may come about such that the charging ability required for the charging member may lower to tend to cause C-set images more conspicuously. If on the other hand the elastic cover layer has a volume resistivity of less than $10^2$ Ωcm, the whole charging member may have excessively low resistance so that it may be difficult to prevent leakage due to pinholes or scratches of the surface of the electrophotographic photosensitive member, the member to be charged.

In order to keep the volume resistivity of the elastic cover layer within the above range, the ethylene oxide unit in the epichlorohydrin rubber may preferably be in a content of from 55 to 85 mol %. If it is in a content of less than 55 mol %, the above volume resistivity is not achievable. If on the other hand it is in a content of more than 85 mol %, not only a difficulty may come about such that the elastic cover layer may have a large C-set deformation level, but also a problem may arise such that the polymer tends to be crystallized to increase the electrical resistance of the elastic cover layer have a high electrical resistance value on the contrary.

In order to control hardness and so forth, additives (such as a softening oil and a plasticizer) may be added to the elastic cover layer.

The elastic cover layer may also be made to serve as the surface layer, i.e., a surface cover layer of the charging member. However, where the additives such as a softening oil and a plasticizer are used in this elastic cover layer, it is preferable for this elastic cover layer not to be the surface layer of the charging member, in order to prevent the additives from oozing out on the surface of the charging member.

The conductivity (volume resistivity) of the elastic cover layer may be controlled by appropriately adding to the above binding material a conducting agent such as carbon black, a conductive metal oxide, an alkali metal salt or an ammonium salt.

In the case where the epichlorohydrin rubber component is used, it is particularly preferable to use the ammonium salt. However, when the epichlorohydrin rubber component is used, the volume resistivity is greatly influenced by the content of the ethylene oxide unit as stated above.

In the case where the additives are used in the elastic cover layer, one or two or more resistance layers (a kind of cover layer) may also be provided between the elastic cover layer and the surface cover layer, from the viewpoint of firmly preventing the additives from oozing out. The resistance layer may preferably have a volume resistivity of from $10^2$ Ωcm or more to $10^{16}$ Ωcm or less. If the resistance layer has a volume resistivity above this range, difficulties may come about such that the charging ability required for the charging member may lower to tend to cause C-set images more conspicuously or that the ability to perform uniform charging (charging uniformity) may lower. If on the other hand the resistance layer has a volume resistivity below the above range, it may be difficult to prevent leakage due to pinholes or scratches of the surface of the electrophotographic photosensitive member, the member to be charged. In order to control the volume resistivity of the resistance layer in this way, one or two or more types of conductive particles may be incorporated in the resistance layer.

In addition to the above various materials, materials having various functions may also appropriately be incorporated in the surface cover layer, elastic cover layer and resistance layer. Such materials may include, e.g., antioxidants such as 2-mercaptobenzimidazole, and lubricants such as stearic acid and zinc stearate.

The surfaces of the surface cover layer, elastic cover layer and resistance layer may also be subjected to surface treatment. The surface treatment may include, e.g., surface working treatment making use of ultraviolet rays or electron rays, and surface modification treatment in which a compound is adhered to, and/or impregnated into, the surface.

The above surface cover layer, elastic cover layer and resistance layer may be formed by applying a sheet-shaped or tube-shaped layer formed beforehand in a given thickness to the support or underlying layer, or covering the support or underlying layer with, a sheet-shaped or tube-shaped layer formed beforehand in a given thickness, or by coating such as electrostatic spray coating or dip coating. A method may also be used in which the layer is roughly formed by extrusion and thereafter subjected to shape adjustment by grinding or polishing, or a method may still also be used in which a material is cured and molded in a mold into a given shape.

In the case where the layers are formed by coating, any solvent will suffice the solvent used in a coating solution as long as it is capable of dissolving the binding material. For example, it may include alcohols such as methanol, ethanol and isopropanol; ketones such as acetone, methyl ethyl ketone and cyclohexanone; amides such as N,N-dimethylformamide and N,N-dimethylacetamide; sulfoxides such as dimethyl sulfoxide; ethers such as tetrahydrofuran, dioxane, and ethylene glycol monomethyl ether; esters such as methyl acetate and ethyl acetate; aliphatic halogenated hydrocarbons such as chloroform, ethylene chloride, dichloroethylene, carbon tetrachloride, and trichloroethylene; and aromatic compounds such as benzene, toluene, xylene, ligroine, chlorobenzene and dichlorobenzene.

As methods for dispersing particles in a cover layer material, known methods may be used. For example, the cover layer material and the particles may be mixed by means of Ribbon blender, Nauta mixer, Henschel mixer, Super mixer or the like, or by means of Banbury mixer, a pressure kneader or the like.

In the case where the layers are formed by coating, the solvent, the cover layer materials and the particles may be mixed, and dispersed using a conventionally known fluid dispersion means such as the ball mill, sand mill, paint shaker, Daino mill or Pearl mill mentioned previously.

(Methods for Measurement of Physical Properties)

Measurement of Microhardness:

The microhardness of the charging member surface in the present invention is measured with a microhardness meter MD-1 Model (manufactured by Koubunshi Keiki Co., Ltd.) in a peak hold mode in an environment of 23° C./55% RH. More specifically, the charging member is placed on a metal plate with blocks preventing rolling. The measuring terminal end is precisely pressed against the charging member surface toward the center of the charging member from the direction vertical to the metal plate, and 5 seconds after, the value is read out. The same process is carried out at 3 places in the peripheral direction of each of 30 to 40 mm positions from both rubber ends and the central portion of the charging member, i.e., at 9 places in total. An average value of the measured values is regarded as the microhardness.

Measurement of Average Particle Diameter:

As to the average particle diameter of the particles in the present invention, only primary particles from which secondarily agglomerated particles have been removed are observed for 100 particles on a transmission electron microscope (TEM), and their projected areas are determined. Circle-equivalent diameters of the projected areas obtained are calculated to find a volume-average particle diameter, which is regarded as the average particle diameter.

Measurement of Volume Resistivity:

In the present invention, the volume resistivity of each of the surface cover layer, elastic cover layer and resistance layer is measured in an environment of 23° C./50% RH, using a resistance measuring instrument HIRESTA-UP, manufactured by Mitsubishi Chemical Corporation, under application of a voltage of 250 V for 30 seconds to a measurement object sample. To measure the volume resistivity where the cover layer is solid, such as rubber, resin or the like, a layer of 2 mm in thickness is formed on a solid material to prepare the measurement object sample. To measure the volume resistivity of the cover layer formed by applying a coating solution, an aluminum sheet is coated with the coating solution, and the coating formed is used as the measurement object sample.

In the present invention, where the particles are in an insulating region, the volume resistivity of the particles is measured in an environment of 23° C./50% RH by using a resistance measuring instrument HIRESTA-UP, manufactured by Mitsubishi Chemical Corporation, and applying to a measurement object sample a voltage suited for the resistance of the measurement object sample (depending on region under which resistance to be measured falls, suitable voltage differs). The volume resistivity of particles in a conducting region is measured in an environment of 23° C./50% RH bu using a resistance measuring instrument LORESTA-GP, manufactured by Mitsubishi Chemical Corporation, under application of a voltage of 10 V to the measurement object sample.

It is preferable that the amount of the measurement object sample to be used is appropriately adjusted taking into account the density of particles whose volume resistivity is to be measured. For example, when the volume resistivity of carbon black is measured, 0.5 g of the carbon black is used and compressed by applying a pressure of 10.1 MPa (102 $kgf/cm^2$) to prepare the measurement object sample.

Figure 1:
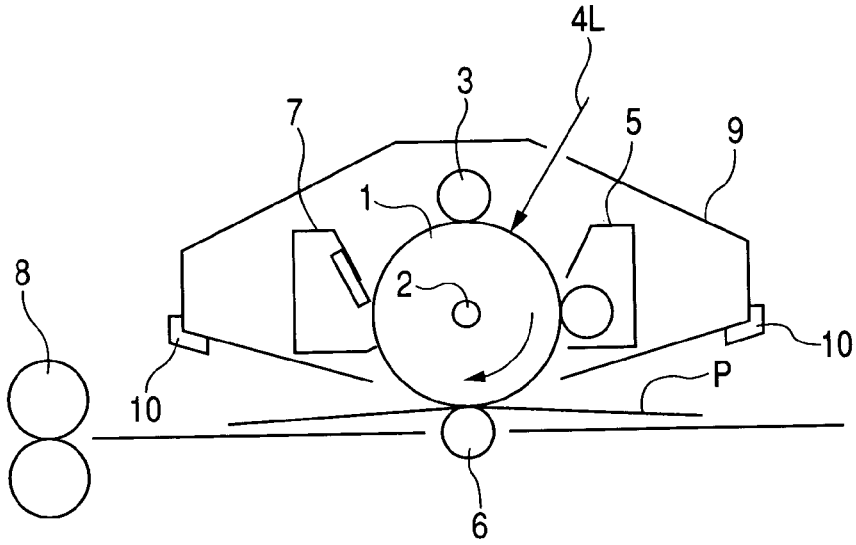
FIG. 1 is a schematic view showing the construction of an example of an electrophotographic apparatus provided with a process cartridge having an electrophotographic photosensitive member and the charging member of the present invention.

The construction of an example of an electrophotographic apparatus provided with a process cartridge having an electrophotographic photosensitive member and the charging member of the present invention is schematically shown in FIG. 1.

In FIG. 1, reference numeral 1 denotes a cylindrical electrophotographic photosensitive member, which is rotatively driven around an axis 2 in the direction of an arrow at a given peripheral speed.

The surface of the electrophotographic photosensitive member 1 being rotatively driven is uniformly electrostatically charged to a positive or negative, given potential through a charging means (in FIG. 1, a roller-shaped charging member, i.e., a charging roller) 3. The electrophotographic photosensitive member thus charged is then exposed to exposure light (imagewise exposure light) 4L emitted from an exposure means (not shown) for slit exposure or laser beam scanning exposure. In this way, electrostatic latent images corresponding to intended images are successively formed on the surface of the electrophotographic photosensitive member 1.

The electrostatic latent images thus formed on the surface of the electrophotographic photosensitive member 1 are developed with a toner contained in a developer in a developing means 5 into toner images. Then, the toner images thus formed and held on the surface of the electrophotographic photosensitive member 1 are successively transferred by the aid of a transfer bias given from a transfer means (such as a transfer roller) 6, onto a transfer material (such as paper) P fed from a transfer material feed means (not shown) to the part (contact zone) between the electrophotographic photosensitive member 1 and the transfer means 6 in such a manner as synchronized with the rotation of the electrophotographic photosensitive member 1.

The transfer material P to which the toner images have been transferred is separated from the surface of the electrophotographic photosensitive member, is guided into a fixing means 8 where the toner images are fixed, and is then put out of the apparatus as an image-formed material (a print or a copy).

The surface of the electrophotographic photosensitive member 1 from which the toner images have been transferred is subjected to removal of the developer (toner) remaining after the transfer, through a cleaning means (such as a cleaning blade) 7. Thus the electrophotographic photosensitive member surface is cleaned, and then repeatedly used for image formation. In addition, after the surface of the electrophotographic photosensitive member has been cleaned by the cleaning means 7, the surface of the electrophotographic photosensitive member 1 may be subjected to charge elimination by pre-exposure light before it is charged by the charging member 3.

The apparatus may be constituted of a combination of plural components held in a housing and integrally joined as a process cartridge from among the constituents such as the above electrophotographic photosensitive member 1, charging member 3, developing means 5, transfer means 6 and cleaning means 7 so that the process cartridge is detachably mountable to the main body of the electrophotographic apparatus such as a copying machine or a laser beam printer. In FIG. 1, the electrophotographic photosensitive member 1, the primary charging means 3, the developing means 5 and the cleaning means 7 are integrally supported in the cartridge to form a process cartridge 9 that is detachably mountable to the main body of the apparatus through a guide means 10 such as rails installed in the main body of the electrophotographic apparatus.

As the electrophotographic photosensitive member 1, an electrophotographic photosensitive member may be employed which comprises, e.g., a cylindrical support (conductive support) and a photosensitive layer formed on the support, containing an inorganic photosensitive material and/or an organic photosensitive material. The electrophotographic photosensitive member 1 may further have a charge injection layer for charging the surface of the electrophotographic photosensitive member to a given polarity and potential.

A developing system the developing means 3 may employ may include, e.g., a jumping developing system, a contact developing system and a magnetic brush system. With an electrophotographic apparatus which reproduces color images (full-color images), the contact developing system is particularly preferred for the purpose of preventing toner scatter.

EXAMPLES

The present invention is described below in greater detail by giving Examples. Note, however, that the present invention is by no means limited to the Examples.

Example 1

Production of Composite Particles:

To 7.0 kg of silica particles (average particle diameter: 17 nm; volume resistivity: $1.8=10^{12}$ Ωcm) as first metal oxide particles, 140 g of methylhydrogenpolysiloxane was added operating an edge runner mill, and these materials were mixed and agitated for 30 minutes at a linear load of 588 N/cm (60 kg/cm). Here the agitation was carried out at a speed of 22 rpm.

Next, 7.0 kg of carbon black particles (average particle diameter: 15 nm; volume resistivity: $2.0 \times 10^2$ Ωcm) were added over a period of 10 minutes, operating an edge runner mill, and these materials were further mixed and agitated for 60 minutes at a linear load of 588 N/cm (60 kg/cm) to adhere the carbon black adhere to methylhydrogenpolysiloxane coatings, followed by drying at 80C for 60 minutes by means of a dryer to produce composite particles. In addition, here the agitation was carried out at a speed of 22 rpm.

The composite particles obtained had an average particle diameter of 15 nm and a volume resistivity of $1.8\times10^2$ Ωcm.

Production of Second Metal Oxide Particles:

1,000 g of rutile type titanium oxide particles (average particle diameter: 15 nm; volume resistivity: $5.2\times10^{10}$ Ωcm), 110 g of isobutyltrimethoxysilane as a surface treating agent and 3,000 g of toluene as a solvent were compounded to prepare a slurry.

This slurry was mixed for 30 minutes by means of a stirrer, and thereafter fed to a Visco mill 80% of whose effective internal volume was filled with glass beads 0.8 mm in average particle diameter, to effect wet disintegration at a temperature of 35 plus-minus 5° C.

The slurry obtained by the wet disintegration was subjected to distillation under reduced pressure (bath temperature: 110° C.; product temperature: 30 to 60° C.; degree of reduced pressure: about 100 Torr) using a kneader to remove the toluene, followed by baking of the surface treating agent at 120° C. for 2 hours. The particles having been subjected to the baking were cooled to room temperature, and thereafter pulverized by means of a pin mill.

Production of Charging Member:

A mandrel of 6 mm in diameter and 252.5 mm in length, made of stainless steel was used as a support (conductive support). This was coated with a heat-curable adhesive (METALOC U-20, available from Toyokagaku Kenkyusho Co., Ltd.), followed by drying.

Next, 100 parts by weight of an epichlorohydrin rubber terpolymer (ethylene oxide (EO)/epichlorohydrin (EP)/allylglycidyl ether (AGE)=73 mol %/23 mol %/4 mol %), 45 parts by weight of calcium carbonate, 8 parts by weight of an aliphatic polyester type plasticizer, 1 part of zinc stearate, 0.5 part by weight of 2-mercaptobenzimidazole (MB) (an antioxidant), 5 parts by weight of zinc oxide, 2 parts by weight of a quaternary ammonium salt represented by the following formula:

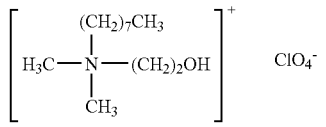

and 5 parts by weight of carbon black (average particle diameter: 50 nm; volume resistivity: 0.1 Ωcm) were kneaded for 10 minutes by means of an enclosed mixer controlled to 50° C., to prepare a raw-material compound.

To this raw-material compound, based on the weight of the epichlorohydrin rubber terpolymer, 1% by weight of sulfur (a vulcanizing agent), 1% by weight of dibenzothiazyl sulfide (DM) (a vulcanization accelerator) and 0.5% by weight of tetramethylthiuram monosulfide (TS) were added, and kneaded for 10 minutes by means of a twin-roll mill cooled to 20° C., to prepare a compound for an elastic cover layer.

This compound for an elastic cover layer was extruded onto the adhesive-coated support by means of an extruder and was so formed as to have the shape of a roller of about 10 mm in external diameter, and then subjected to vulcanization and curing of the adhesive, at 160° C. for 1 hour in an electric oven. Thereafter, both ends of the rubber layer were cut through, followed by surface grinding working which was so carried out as to have the shape of a roller of 8.5 mm in external diameter. Thus, an elastic cover layer was formed on the support. Here, the crown level (the difference between an external diameter at the middle portion and an external diameter at positions 90 mm away from the middle portion) was set to be 110 μm.

Subsequently, to a caprolactone-modified acrylpolyol solution (trade name: PLACCEL DC2016, available from Daicel Chemical Industries, Ltd.), methyl isobutyl ketone was so added as to adjust the former'solid content of the solution to 20% by weight.

To 500 parts by weight of the resultant solution, the following materials were further added to prepare a fluid mixture.

| | (by weight) |
|---|---|
| Above composite particles | 30 parts |
| Above second metal oxide particles | 25 parts |
| Modified dimethylsilicone oil (trade name: SH28PA, available from Dow Corning Toray Silicone Co., Ltd.) | 0.08 part |
| 1:1 Mixture of hexamethylene diisocyanate (HDI) and isophorone diisocyanate (IPDI) each blocked with butanone oxime | 98.84 parts |

Here, the mixture of HDI and IPDI was so added as to be NCO/OH=1.0. As HDI and IPDI, HDI (trade name: DURANATE TPA-B80E, available from Asahi Chemical Industry Co. Ltd.) and IPDI (trade name: BESTANATO B1370, available from Degussa-Hulls AG) were used.

In a 450 ml glass bottle, 280 g of the above fluid mixture and 200 g of glass beads of 0.8 mm in average particle diameter as a dispersion media were mixed, followed by dispersion for 12 hours using a paint shaker dispersion machine to prepare a fluid dispersion (a surface cover layer coating fluid).

The elastic cover layer was dip-coated once with this surface cover layer coating fluid, followed by air drying at normal temperature for 30 minutes or more, subsequently drying for 1 hour by means of a circulating hot-air dryer set at 80° C., and further drying for 1 hour by means of a circulating hot-air dryer set at 160° C. to form a surface cover layer on the elastic cover layer. Here, the dip coating dipping time was 9 seconds, and the dip coating lifting rate was so set that the initial rate was 20 mm/second and the final rate was 2 mm/second where, in the course of from 20 mm/second to 2 mm/second, the rate was changed linearly with respect to time.

Thus, a charging roller was produced, having on the support the elastic cover layer and the surface cover layer (outermost layer) in this order.

The microhardness of the surface of the charging member in this Example was measure by the method described previously. The results are shown in Table 3.

<Evaluation on C-Set>

The charging member produced was brought into contact with an electrophotographic photosensitive drum, and left standing for a month in an environment of 40° C./95% RH. The photosensitive drum used in this Example was 24 mm in diameter. The charging member was pressed against the drum by spring pressing force at a total pressure of 1 kgw with pressure being 0.5 kgw per end.

Figure 2:
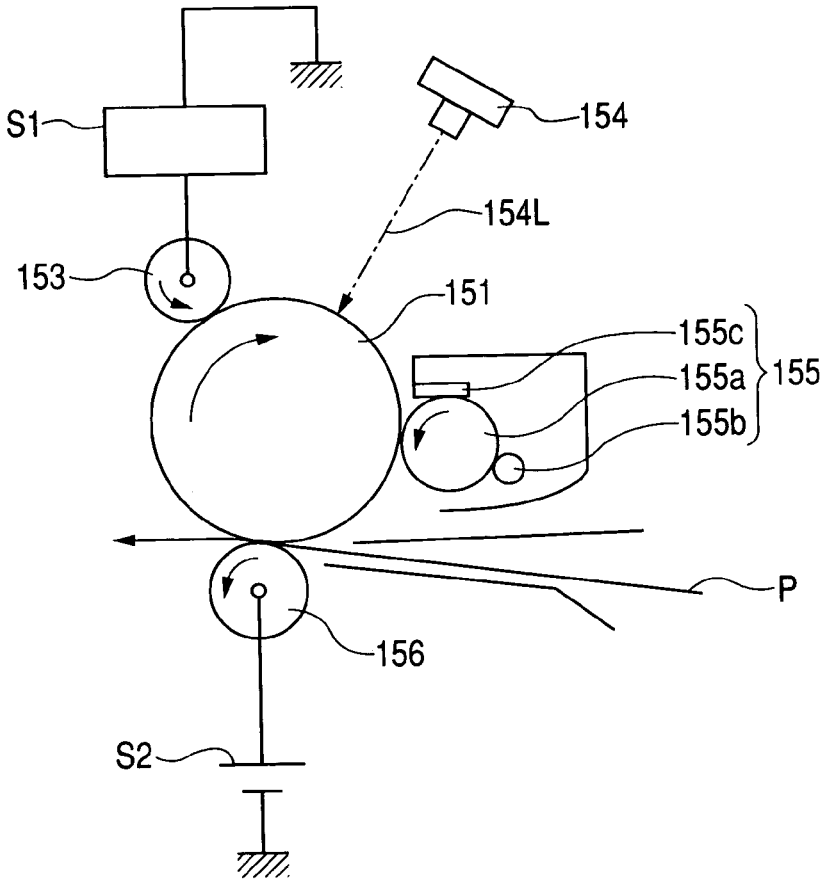
FIG. 2 is a schematic view showing the construction of an electrophotographic apparatus used in Examples and Comparative Examples.

After left standing for a month in an environment of 40° C./95% RH, the charging member was taken out of the above environment in the state it was kept in contact with the photosensitive drum, and then left standing for 6 hours in an environment of 23° C./50% RH. Thereafter, the charging member kept in contact with the photosensitive drum was set in an electrophotographic apparatus constructed as shown in FIG. 2 (only a DC voltage was applied to the charging member), where halftone images were reproduced in the environment of 23° C./50% RH to evaluate the images reproduced.

The environment of 40° C./95% RH is higher in both temperature and humidity than the usual service environment of electrophotographic apparatus, and the charging member deforms in a large level. Accordingly, if no C-set images appear under such conditions, it can be said that the problem concerning the C-set does not come about over a long period of time.

In addition, the surface potential (dark-area potential) of the electrophotographic photosensitive member after charged by the charging member was so controlled as to be −400 V. Also, the process speed was set at 94 mm/second.

The evaluation results of the images reproduced are shown in Table 3. In Table 3, image evaluation is ranked as follows:

Rank 1: Very good.

Rank 2: Good.

Rank 3: Line-like image defects are slightly seen on halftone images.

Rank 4: Line-like image defects are conspicuous.

The electrophotographic apparatus constructed as shown in FIG. 2 is described below.

Reference numeral 151 denotes a cylindrical electrophotographic photosensitive member, which is 24 mm in diameter in this Example. This electrophotographic photosensitive member 151 is rotatively driven in the direction of an arrow at a given process speed (94 mm/second).

Reference numeral 153 denotes a charging roller. S1 denotes a power source for applying only a DC voltage to the charging roller. The charging roller 153 is kept in contact (touch) with the electrophotographic photosensitive member 151 at a given pressing force (spring pressure), and is rotatively driven in the direction following the rotation of the electrophotographic photosensitive member 151 (kept in contact by spring pressing force at a total pressure of 1 kgw with pressure being 0.5 kgw per end). To this charging roller 153, only a DC voltage of −1,000 V is applied from the power source S1, whereby the surface of the electrophotographic photosensitive member 151 is charged (contact-charged) to −400 V.

Reference numeral 154 denotes a laser beam scanner as an exposure means. The surface of the electrophotographic photosensitive member 151 charged to −400 V (dark-area potential) by the charging roller 153 is irradiated with exposure (imagewise exposure) light 154L corresponding to the intended image information, by means of the laser beam scanner 154, whereby the potential of −400 V of the surface of the electrophotographic photosensitive member is selectively attenuated to −150V (light-area potential), so that an electrostatic latent image is formed on the surface of the electrophotographic photosensitive member 151.

Reference numeral 155 denotes a developing assembly (developing means). The developing assembly 155 has a toner carrying member 155*a* which is provided at an opening of a developer container holding a toner (developer) and carries and transports the toner, an agitation member 155*b* which agitates the toner held in the developer container, and a toner control member 155*c* which controls the level of the toner held on the toner carrying member 155*a* (i.e., toner layer thickness). In the developing assembly 155, a toner (a negative toner) standing charged to −350 V (development bias) is adhered selectively to light-area potential areas of the electrostatic latent image formed on the surface of the electrophotographic photosensitive member 151 to render the electrostatic latent image visible as a toner image. The toner carrying member 155*a* is in contact with the electrophotographic photosensitive member 151, or in contact with the electrophotographic photosensitive member 151 via the toner being carried. That is, it employs the contact developing system. Accordingly, from the viewpoint of securing contact stability, the toner carrying member 155*a* is made to be a developing roller comprising a support (conductive support) and provided thereon an elastic cover layer (made of a rubber) endowed with conductivity. Of course, in the elastic cover layer, a foam may be used as an elastic material, or an additional layer may be provided on the elastic cover layer, or the elastic cover layer may be subjected to surface treatment such as surface working treatment making use of ultraviolet rays or electron rays, and surface modification treatment in which a compound is adhered to, and/or impregnated into, the surface.

Reference numeral 156 denotes a transfer roller as a transfer means. The transfer roller 156 is a transfer roller having a support (conductive support) coated with an elastic resin layer controlled to medium resistance. The transfer roller 156 is kept in contact with the electrophotographic photosensitive member 151 under a given pressing force to form a transfer nip between them, and is rotated in the direction following the rotation of the electrophotographic photosensitive member 151 at a peripheral speed substantially equal to the rotational peripheral speed of the electrophotographic photosensitive member 151. Also, a transfer voltage having a polarity opposite to the charge polarity of the toner is applied from a power source S2. A transfer material P is fed at a given timing from a paper feed mechanism section (not shown) to the transfer nip, and is charged on its back, to a polarity opposite to the charge polarity of the toner by means of a transfer roller 156 to which a transfer voltage is applied, whereby the toner image on the surface of the electrophotographic photosensitive member 151 is electrostatically transferred to the surface (the side facing the electrophotographic photosensitive member 151) of the transfer material P at the transfer nip.

The transfer material P to which the toner image has been transferred at the transfer nip is separated from the surface of the electrophotographic photosensitive member 151, and is guided into a fixing assembly (not shown), where the toner image is subjected to fixing. Then the image-fixed transfer material is put out as an image-formed matter. In the case of a double-side image-forming mode or a multiple-image-forming mode, this image-formed matter is guided into a recirculation delivery mechanism (not shown) and is again guided to the transfer nip.

Transfer residual toner on the surface of the electrophotographic photosensitive member 151 is collected by a cleaning blade (not shown). Thereafter, the surface of the electrophotographic photosensitive member 151 is again electrostatically charged by the charging roller 153, and images are repeatedly formed thereon.

<Measurement of C-Set Deformation Level>

Images were reproduced as described above, and at the same time the C-set deformation level of the charging member was measured.

In the case where the charging member was a roller-shaped charging member, a charging roller, the radius of the roller was measured assuming the support (conductive support) to be a shaft, and the difference in radius between the most deformed part in the contact portion and the non-contact part was regarded as the C-set deformation level. In the measurement, a full-automatic roller measuring instrument manufactured by Tokyo Opto-Electronics Co., Ltd. was used, where the charging member was rotated by 1° at a time to make measurement concerning 360°. The difference between the smallest value of the radii in the contact portion and the radius in the non-contact part was regarded as the C-set deformation level. This measurement was made at 3 places, the middle portion in the lengthwise direction of the roller and two positions 90 mm away from the middle portion. The largest deformation level was regarded as the deformation level of the charging member.

In the case where the charging member was sheet-shaped, belt-shaped or plate-shaped, the measurement was made using a surface roughness measuring instrument SE-3400, manufactured by Kosaka Laboratory Ltd. Stated in detail, the measurement was made over the length of 8 mm so that the contact portion was able to be measured with this measuring instrument under the same conditions as in the measurement of ten-point average surface roughness in the JIS B 0601 surface roughness standard, and the difference in level between the most deformed part in the contact portion and the non-contact part was regarded as the C-set deformation level. This measurement was made at 3 spots, the middle portion in the lengthwise direction of the charging member and two positions 90 mm away from the middle portion. The largest deformation level was regarded as the deformation level of the charging member.

The results of measurement of the C-set deformation level are shown in Table 3.

Examples 2 to 11

Composite particles were produced in the same manner as in Example 1 except that the first metal oxide particles, the material for and amount of the surface treating agent to be added and the type and amount of the carbon black to be added were changed as shown in Table 1. The average particle diameter and volume resistivity of the composite particles are shown in Table 1.

Second metal oxide particles were produced in the same manner as in Example 1 except that the amount of the surface treating agent to be used for the metal oxide particles was changed as shown in Table 2.

Charging members were produced in the same manner as in Example 1 except that the parts by weight of the composite particles and second metal oxide particles to be used in forming surface cover layers (outermost layers) were changed as shown in Table 3. As the composite particles and the second metal oxide particles, those produced by the above methods were used.

In regard to the charging members thus produced, the measurement of microhardness of the charging member surfaces, the measurement of C-set deformation level and the evaluation on C-set images were made in the same manner as in Example 1. The results are shown in Table 3.

Example 12

First metal oxide particles were produced in the following way.

A slurry containing titanium oxide particles was produced using 20 kg of rutile type titanium oxide particles (average particle diameter: 50 nm) and 150 L of water. The pH value of the slurry containing the titanium oxide particles obtained was adjusted to 10.5 using an aqueous sodium hydroxide solution. Next, water was added to the resultant slurry to adjust the slurry concentration to 98 g/L. Then, 150 L of this slurry was heated to 60° C., and 5,444 mL (corresponding to 0.5% by weight based on titanium oxide particles) of a 1.0 mol/L NaAlO2 solution was added to the slurry. After left standing for this was kept for 30 minutes, the pH value was adjusted to 7.5 using acetic acid. This slurry was left standing for 30 minutes in this state, followed by filtration, washing with water, drying and then pulverization to prepare rutile type titanium oxide particles the particle surfaces of which were coated with a hydroxide of aluminum. Their volume resistivity was 1.1 x $10^{10}$ Ωcm.

Composite particles were produced in the same manner as in Example 1 except that the above particles were used as the first metal oxide particles and that the material for and amount of the surface treating agent to be added and the type and amount of the carbon black to be added were changed as shown in Table 1. The average particle diameter and volume resistivity of the composite particles produced are shown in Table 1.

Second metal oxide particles were produced in the same manner as in Example 1.

A charging member was produced in the same manner as in Example 1 except that the parts by weight of the composite particles and second metal oxide particles to be used in forming a surface cover layer (outermost layer) were changed as shown in Table 3. As the composite particles and the second metal oxide particles, those produced by the above methods were used.

In regard to the charging members thus produced, the measurement of microhardness of the charging member surface, the measurement of C-set deformation level and the evaluation on C-set images were made in the same manner as in Example 1. The results are shown in Table 3.

Example 13

Composite particles were produced in the same manner as in Example 1 except that the first metal oxide particles and the type and amount of the carbon black to be added were changed as shown in Table 1. In this Example, the first metal oxide particles were not surface-treated. The average particle diameter and volume resistivity of the composite particles are shown in Table 1.

Second metal oxide particles were produced using the material shown in Table 2, and were not surface-treated.

A charging member was produced in the same manner as in Example 1 except that the parts by weight of the composite particles and second metal oxide particles to be used in forming a surface cover layer (outermost layer) were changed as shown in Table 3. As the composite particles and the second metal oxide particles, those produced by the above methods were used.

In regard to the charging members thus produced, the measurement of microhardness of the charging member surface, the measurement of C-set deformation level and the evaluation on C-set images were made in the same manner as in Example 1. The results are shown in Table 3.

Examples 14 to 19 and 21

Composite particles were produced in the same manner as in Example 1 except that the first metal oxide particles, the material for and amount of the surface treating agent to be added and the type and amount of the carbon black to be added were changed as shown in Table 1. The average particle diameter and volume resistivity of the composite particles are shown in Table 1.

Second metal oxide particles were produced in the same manner as in Example 1 except that the material for metal oxide particles and the material for and amount of the surface treating agent to be added were changed as shown in Table 2.

Charging members were produced in the same manner as in Example 1 except that the parts by weight of the composite particles and second metal oxide particles to be used in forming surface cover layers (outermost layers) were changed as shown in Table 3. As the composite particles and the second metal oxide particles, those produced by the above methods were used.

In regard to the charging members thus produced, the measurement of microhardness of the charging member surfaces, the measurement of C-set deformation level and the evaluation on C-set images were made in the same manner as in Example 1. The results are shown in Table 3.

Example 20

A charging member was produced in the same manner as in Example 19 except that, in the surface treatment of the second metal oxide particles, 100 g of isobutyltrimethoxysilane and 100 g of methylhydrogenpolysiloxane were used as the surface treating agent.

In regard to the charging members thus produced, the measurement of microhardness of the charging member surfaces, the measurement of C-set deformation level and the evaluation on C-set images were made in the same manner as in Example 1. The results are shown in Table 3.

Example 22

A charging member was produced in the same manner as in Example 21 except that the second metal oxide particles were not surface-treated.

In regard to the charging members thus produced, the measurement of microhardness of the charging member surfaces, the measurement of C-set deformation level and the evaluation on C-set images were made in the same manner as in Example 1. The results are shown in Table 3.

Examples 23 and 24

Charging members were produced in the same manner as in Example 2 except that the ratio of ethylene oxide (EO)/epichlorohydrin (EP)/allylglycidyl ether (AGE) in the epichlorohydrin rubber terpolymer used in forming the elastic cover layer was changed as shown in Table 3.

In regard to the charging members thus produced, the measurement of microhardness of the charging member surfaces, the measurement of C-set deformation level and the evaluation on C-set images were made in the same manner as in Example 1. The results are shown in Table 3.

Example 25

A charging member was produced in the same manner as in Example 1 except that 50 parts by weight of cross-linked polymethyl methacrylate (PMMA) particles (average particle diameter: 5.0 μm (5,000 nm); volume resistivity: $1.0\times10^{15}$ Ωcm) was further added in preparing the surface cover layer (outermost layer) coating fluid.

In regard to the charging members thus produced, the measurement of microhardness of the charging member surfaces, the measurement of C-set deformation level and the evaluation on C-set images were made in the same manner as in Example 1. The results are shown in Table 3.

Comparative Example 1

A charging member was produced in the same manner as in Example 1 except that the composite particles and the second metal oxide particles were not used and 30 parts by weight of carbon black (average particle diameter: 20 nm; volume resistivity: 100 Ωcm) was used in preparing the surface cover layer (outermost layer) coating fluid.

In regard to the charging members thus produced, the measurement of microhardness of the charging member surfaces, the measurement of C-set deformation level and the evaluation on C-set images were made in the same manner as in Example 1. The results are shown in Table 3.

Comparative Example 2

A charging member was produced in the same manner as in Comparative Example 1 except that 10 parts by weight of surface-treated silica particles were further added as second metal oxide particles in preparing the surface cover layer (outermost layer) coating fluid.

The above second metal oxide particles were produced in the same manner as in Example 1 except that the material for metal oxide particles and the material for and amount of the surface treating agent to be added were changed as shown in Table 2.

In regard to the charging members thus produced, the measurement of microhardness of the charging member surfaces, the measurement of C-set deformation level and the evaluation on C-set images were made in the same manner as in Example 1. The results are shown in Table 3.

Comparative Example 3

A charging member was produced in the same manner as in Example 14 except that the second metal oxide particles were not used.

In regard to the charging members thus produced, the measurement of microhardness of the charging member surfaces, the measurement of C-set deformation level and the evaluation on C-set images were made in the same manner as in Example 1. The results are shown in Table 3.

TABLE 1

| | First metal oxide particles | | | Surface treatment | | Carbon black | | | Composite particles | |
|---|---|---|---|---|---|---|---|---|---|---|
| | Material | Av. particle diam. (nm) | Volume resistivity (Ωcm) | Material for surface treating agent | Amt. (g) | Av. particle diam. (nm) | Volume resistivity (Ωcm) | Amt. (kg) | Av. particle diam. (nm) | Volume resistivity (Ωcm) |
| Example: | | | | | | | | | | |
| 1 | Silica | 17 | $1.8\times10^{12}$ | Methylhydrogen-polysiloxane | 140 | 15 | 200 | 7 | 15 | 180 |
| 2 | Silica | 50 | $1.8\times10^{12}$ | Isobutyltri-methoxysilane | 700 | 15 | 200 | 3.5 | 53 | 300 |
| 3 | Silica | 1.3 | $5\times10^{12}$ | Methylhydrogen-polysiloxane | 210 | 15 | 200 | 21 | 1.2 | 100 |
| 4 | Silica | 200 | $3\times10^{12}$ | Methylhydrogen-polysiloxane | 560 | 15 | 200 | 7 | 220 | 89 |
| 5 | Sr titanate | 470 | $5\times10^{13}$ | Methyltri-ethoxysilane | 910 | 15 | 200 | 1.4 | 450 | 500 |
| 6 | Sr titanate | 560 | $2\times10^{13}$ | Methyltri-ethoxysilane | 700 | 15 | 200 | 1.4 | 500 | 100 |
| 7 | Ca titanate | 640 | $1\times10^{13}$ | Trifluropropyl-trimethoxysilane | 910 | 15 | 200 | 1.4 | 630 | 47 |
| 8 | Ca titanate | 980 | $1\times10^{13}$ | Trifluropropyl-trimethoxysilane | 280 | 15 | 200 | 0.35 | 984 | 89 |
| 9 | Rutile $TiO_2$ | 35 | $1\times10^{15}$ | Isobutyltri-methoxysilane | 770 | 15 | 200 | 3.5 | 30 | 130 |
| 10 | Alumina | 68 | $1\times10^{13}$ | Dimethyldi-Methoxysilane | 770 | 30 | 10 | 2.1 | 74 | 140 |
| 11 | Ba titanate | 580 | $1\times10^{16}$ | Phenyltri-ethoxysilane | 70 | 100 | 5 | 1.4 | 590 | 500 |
| 12 | Al-treated rutile $TiO_2$ | 50 | $1.1\times10^{10}$ | Isobutyltri-methoxysilane | 770 | 100 | 5 | 2.1 | 45 | 240 |
| 13 | Silica | 2.3 | $1.8\times10^{13}$ | — | — | 12 | 10 | 28 | 2.1 | 70 |
| 14 | Iron oxide | 67 | $1\times10^{12}$ | Methyltri-ethoxysilane | 700 | 20 | 13 | 0.35 | 75 | 100 |
| 15 | Silica | 24 | $1\times10^{12}$ | Methylhydrogen-polysiloxane | 140 | 20 | 200 | 7 | 200 | 180 |

TABLE 1-continued

| | First metal oxide particles | | | Surface treatment | | Carbon black | | | Composite particles | |
|---|---|---|---|---|---|---|---|---|---|---|
| | Material | Av. particle diam. (nm) | Volume resistivity (Ωcm) | Material for surface treating agent | Amt. (g) | Av. particle diam. (nm) | Volume resistivity (Ωcm) | Amt. (kg) | Av. particle diam. (nm) | Volume resistivity (Ωcm) |
| 16 | Silica | 24 | $1 \times 10^{12}$ | Methylhydrogen-polysiloxane | 140 | 20 | 200 | 7 | 200 | 180 |
| 17 | Silica | 24 | $1 \times 10^{12}$ | Methylhydrogen-polysiloxane | 140 | 20 | 200 | 7 | 200 | 180 |
| 18 | Silica | 24 | $1 \times 10^{12}$ | Methylhydrogen-polysiloxane | 140 | 20 | 200 | 7 | 200 | 180 |
| 19 | Silica | 24 | $1 \times 10^{12}$ | Methylhydrogen-polysiloxane | 140 | 20 | 200 | 7 | 200 | 180 |
| 20 | Silica | 24 | $1 \times 10^{12}$ | Methylhydrogen-polysiloxane | 140 | 20 | 200 | 7 | 200 | 180 |
| 21 | Silica | 24 | $1 \times 10^{12}$ | Methylhydrogen-polysiloxane | 140 | 20 | 200 | 7 | 200 | 180 |
| 22 | Silica | 24 | $1 \times 10^{12}$ | Methylhydrogen-polysiloxane | 140 | 20 | 200 | 7 | 200 | 180 |
| 23 | Silica | 50 | $1.8 \times 10^{12}$ | Isobutyltri-methoxysilane | 700 | 15 | 200 | 3.5 | 53 | 300 |
| 24 | Silica | 50 | $1.8 \times 10^{12}$ | Isobutyltri-methoxysilane | 700 | 15 | 200 | 3.5 | 53 | 300 |
| 25 | Silica | 17 | $1.8 \times 10^{12}$ | Methylhydrogen-polysiloxane | 140 | 15 | 200 | 7 | 15 | 180 |
| Comparative Example: | | | | | | | | | | |
| 3 | Iron oxide | 67 | $1 \times 10^{12}$ | Methyltri-ethoxysilane | 700 | 20 | 13 | 0.35 | 75 | 100 |

TABLE 2

| | Second metal oxide particles | | | Surface treatment | |
|---|---|---|---|---|---|
| | Material | Average particle diameter (nm) | Volume resistivity (Ωcm) | Material(s) for surface treating agent | Amount (g) |
| Example: | | | | | |
| 1 | Rutile titanium oxide | 15 | $5.2 \times 10^{15}$ | Isobutyltrimethoxysilane | 110 |
| 2 | Rutile titanium oxide | 15 | $5.2 \times 10^{15}$ | Isobutyltrimethoxysilane | 110 |
| 3 | Rutile titanium oxide | 15 | $5.2 \times 10^{15}$ | Isobutyltrimethoxysilane | 110 |
| 4 | Rutile titanium oxide | 15 | $5.2 \times 10^{15}$ | Isobutyltrimethoxysilane | 120 |
| 5 | Rutile titanium oxide | 15 | $5.2 \times 10^{15}$ | Isobutyltrimethoxysilane | 90 |
| 6 | Rutile titanium oxide | 15 | $5.2 \times 10^{15}$ | Isobutyltrimethoxysilane | 30 |
| 7 | Rutile titanium oxide | 15 | $5.2 \times 10^{15}$ | Isobutyltrimethoxysilane | 110 |
| 8 | Rutile titanium oxide | 15 | $5.2 \times 10^{15}$ | Isobutyltrimethoxysilane | 110 |
| 9 | Rutile titanium oxide | 15 | $5.2 \times 10^{15}$ | Isobutyltrimethoxysilane | 110 |
| 10 | Rutile titanium oxide | 15 | $5.2 \times 10^{15}$ | Isobutyltrimethoxysilane | 110 |
| 11 | Rutile titanium oxide | 15 | $5.2 \times 10^{15}$ | Isobutyltrimethoxysilane | 110 |
| 12 | Rutile titanium oxide | 15 | $5.2 \times 10^{15}$ | Isobutyltrimethoxysilane | 110 |
| 13 | Rutile titanium oxide | 15 | $5.2 \times 10^{15}$ | — | — |
| 14 | Rutile titanium oxide | 15 | $5.2 \times 10^{15}$ | Isobutyltrimethoxysilane | 110 |
| 15 | Silica | 41 | $2.3 \times 10^{12}$ | Isobutyltrimethoxysilane | 120 |
| 16 | Silica | 1.2 | $1.2 \times 10^{13}$ | Methylhydrogenpolysiloxane | 20 |
| 17 | Anatase titanium oxide | 35 | $3.4 \times 10^{12}$ | Dimethyldimethoxysilane | 10 |
| 18 | Strontium titanate | 470 | $1.1 \times 10^{14}$ | Trifluoropropyltrimethoxysilane | 120 |
| 19 | Calcium titanate | 980 | $1.2 \times 10^{15}$ | Methylhydrogenpolysiloxane | 50 |
| 20 | Rutile titanium oxide | 312 | $5.7 \times 10^{14}$ | Isobutyltrimethoxysilane + methylhydrogenpolysiloxane | 100<br>100 |
| 21 | Rutile titanium oxide | 57 | $2.3 \times 10^{13}$ | Methylhydrogenpolysiloxane | 130 |
| 22 | Rutile titanium oxide | 57 | $2.3 \times 10^{13}$ | — | — |
| 23 | Rutile titanium oxide | 15 | $5.2 \times 10^{15}$ | Isobutyltrimethoxysilane | 110 |
| 24 | Rutile titanium oxide | 15 | $5.2 \times 10^{15}$ | Isobutyltrimethoxysilane | 110 |
| 25 | Rutile titanium oxide | 15 | $5.2 \times 10^{15}$ | Isobutyltrimethoxysilane | 110 |
| Comparative Example: | | | | | |
| 2 | Silica | 41 | $2.3 \times 10^{12}$ | Isobutyltrimethoxysilane | 100 |

TABLE 3

| | Outermost layer | | | | | |
|---|---|---|---|---|---|---|
| | Amount of composite particles (pbw) | Amount of second metal oxide particles (pbw) | Elastic cover layer EO/EP/AGE (mol %) | Charging member surface micro-hardness (°) | C-set characteristics Deformation level (μm) | C-set characteristics Image rank |
| Example: | | | | | | |
| 1 | 30 | 25 | 73/23/4 | 65 | 8 | 1 |
| 2 | 30 | 25 | 73/23/4 | 61 | 9 | 1 |
| 3 | 10 | 5 | 73/23/4 | 56 | 16 | 3 |
| 4 | 40 | 100 | 73/23/4 | 63 | 14 | 1 |
| 5 | 8 | 5 | 73/23/4 | 58 | 13 | 2 |
| 6 | 20 | 30 | 73/23/4 | 76 | 15 | 2 |
| 7 | 10 | 50 | 73/23/4 | 65 | 13 | 3 |
| 8 | 15 | 25 | 73/23/4 | 52 | 18 | 3 |
| 9 | 30 | 25 | 73/23/4 | 59 | 10 | 1 |
| 10 | 30 | 2 | 73/23/4 | 76 | 12 | 1 |
| 11 | 10 | 50 | 73/23/4 | 69 | 14 | 2 |
| 12 | 50 | 25 | 73/23/4 | 64 | 12 | 2 |
| 13 | 100 | 25 | 73/23/4 | 64 | 15 | 3 |
| 14 | 30 | 25 | 73/23/4 | 53 | 12 | 2 |
| 15 | 30 | 3 | 73/23/4 | 65 | 15 | 3 |
| 16 | 30 | 3 | 73/23/4 | 59 | 14 | 3 |
| 17 | 30 | 20 | 73/23/4 | 73 | 16 | 2 |
| 18 | 30 | 70 | 73/23/4 | 67 | 15 | 2 |
| 19 | 30 | 12 | 73/23/4 | 57 | 16 | 3 |
| 20 | 30 | 10 | 73/23/4 | 53 | 12 | 1 |
| 21 | 30 | 50 | 73/23/4 | 56 | 15 | 2 |
| 22 | 30 | 30 | 73/23/4 | 75 | 14 | 2 |
| 23 | 30 | 25 | 56/40/4 | 64 | 13 | 2 |
| 24 | 30 | 25 | 85/11/4 | 52 | 17 | 3 |
| 25 | 30 | 25 | 73/23/4 | 56 | 10 | 1 |
| Comparative Example: | | | | | | |
| 1 | — | — | 73/23/4 | 89 | 17 | 4 |
| 2 | — | 10 | 73/23/4 | 79 | 19 | 4 |
| 3 | 30 | — | 73/23/4 | 65 | 20 | 4 |

According to the present invention, a charging member can be provided which can contribute to reproduction of good images free of image defects (in particular, C-set images) even when used in electrophotographic apparatus in which the voltage applied to the charging member is only a DC voltage. A process cartridge and an electrophotographic apparatus can also be provided which have such a charging member.

This application claims priority from Japanese Patent Application Nos. 2004-229504 filed Aug. 5, 2004 and 2005-154894 filed May 27, 2005, which are hereby incorporated by reference herein.

What is claimed is:

1. A charging member comprising:

a support; and at least one cover layer provided on said support, wherein said cover layer includes an outermost layer positioned at an outermost surface of the charging member, wherein said outermost layer contains (i) composite particles including first metal oxide particles coated with carbon black, (ii) second metal oxide particles uncoated with carbon black, and (iii) a binder, wherein said second metal oxide particles are insulating metal oxide particles, and wherein said composite particles and said second metal oxide particles are in a weight ratio of composite particles to second metal oxide particles in a range of 0.2 to 3.9.

2. A charging member according to claim 1, wherein said outermost layer is formed of a matrix comprising said binder, wherein said matrix has a plurality of first segments containing said composite particles and a plurality of second segments containing said second metal oxide particles.

wherein said first segments have a higher affinity for said binder than said second segments, and wherein said first segments are separated from one another by said second segments.

3. The charging member according to claim 1, wherein said first metal oxide particles are particles of a metal oxide selected from the group consisting of silica, alumina, titanium oxide, zinc oxide, magnesium oxide, iron oxide, strontium titanate, calcium titanate, magnesium titanate, barium titanate, and calcium zirconate, and wherein said second metal oxide particles are particles of a metal oxide selected from the group consisting of silica, alumina, titanium oxide, zinc oxide, magnesium oxide, iron oxide, strontium titanate, calcium titanate, magnesium titanate, barium titanate, and calcium zirconate.

4. The charging member according to claim 1, wherein said second metal oxide particles have a dielectric constant of 30 or more.

5. The charging member according to claim 4, wherein said second metal oxide particles are particles of a metal oxide selected from the group consisting of titanium oxide, strontium titanate, calcium titanate, and barium titanate.

6. The charging member according to claim 1, wherein said second metal oxide particles have an average particle diameter in a range of 1 nm to 1,000 nm.

7. The charging member according to claim 1, wherein said composite particles have an average particle diameter in a range of from 1 nm to 1,000 nm.

8. The charging member according to claim 1, wherein at least one of said first metal oxide particles and said second metal oxide particles have been subjected to a surface treatment.

9. The charging member according to claim 8, wherein said surface treatment is carried out using an organosilicon compound.

10. The charging member according to claim 1, wherein said first metal oxide particles are insulating metal oxide particles.

11. The charging member according to claim 1, wherein said cover layer comprises at least two layers comprising said outermost layer and a conductive elastic layer provided between said support and said outermost layer.

12. The charging member according to claim 11, wherein said conductive elastic layer contains as a primary chief component an epichlorohydrin rubber.

13. The charging member according to claim 12, wherein said epichiorohydrin rubber includes an ethylene oxide unit in a content in a range of 55 mol % to 85 mol %.

14. A process cartridge comprising:

an electrophotographic photosensitive member; and a charging member, wherein said electrophotographic photosensitive member and said charging member are integrally supported, and detachably mountable to a main body of an electrophotographic apparatus, wherein said charging member includes a support and at least one cover layer provided on said support, wherein said cover layer of said charging member includes an outermost layer positioned at an outermost surface of the charging member, wherein said outermost layer containing (i) composite particles including first metal oxide particles coated with carbon black, (ii) second metal oxide particles being uncoated with carbon black, and (iii) a binder, wherein said second metal oxide particles are insulating metal oxide particles, and wherein said composite particles and said second metal oxide particles are in a weight ratio of composite particles to second metal oxide particles in a range of 0.2 to 3.9.

15. An electrophotographic apparatus comprising:

an electrophotographic photosensitive member, a charging member;

an exposure means;

a developing means; and a transfer means, wherein said charging member includes a support and at least one cover layer provided on said support;

wherein said cover layer of said charging member includes an outermost layer positioned at an outermost surface of the charging member, wherein said outermost layer contains (i) composite particles including first metal oxide particles coated with carbon black, (ii) second metal oxide particles uncoated with carbon black, and (iii) a binder, wherein said second metal oxide particles are insulating metal oxide particles, and wherein said composite particles and said second metal oxide particles are in a weight ratio of composite particles to second metal oxide particles in a range of 0.2 to 3.9.

16. The electrophotographic apparatus according to claim 15, further comprising a voltage applying means for applying a voltage of only a direct current voltage to said charging member.

17. A charging member comprising:

a support; and at least one cover layer provided on said support, wherein said cover layer includes an outermost layer positioned at an outermost surface of the charging member, wherein said outermost layer contains (i) composite particles including first metal oxide particles coated with carbon black, (ii) second metal oxide particles uncoated with carbon black, and (iii) a binder, wherein said second metal oxide particles are insulating metal oxide particles, wherein said composite particles and said second metal oxide particles are in a weight ratio of composite particles to second metal oxide particles in a range of 0.2 to 3.9, wherein an average particle diameter of said composite particles is in a range of 5 nm to 500 nm, and wherein a microhardness of the surface of the charging member is in a range of 53° to 76° .

18. A process cartridge comprising:

an electrophotographic photosensitive member, and a charging member, wherein said electrophotographic photosensitive member and said charging member are integrally supported, and detachably mountable to a main body of an electrophotographic apparatus, wherein said charging member includes a support and at least one cover layer provided on said support, wherein said cover layer of said charging member includes an outermost layer positioned at an outermost surface of the charging member, wherein said outermost layer contains (i) composite particles including first metal oxide particles coated with carbon black, (ii) second metal oxide particles uncoated with carbon black, and (iii) a binder, wherein said second metal oxide particles are insulating metal oxide particles, wherein said composite particles and said second metal oxide particles are in a weight ratio of composite particles to second metal oxide particles in a range of 0.2 to 3.9, wherein an average particle diameter of said composite particles is in a range of 5 nm to 500 nm, and wherein a microhardness of the surface of the charging member is in a range of 53° to 76° .

19. An electrophotographic apparatus comprising:

an electrophotographic photosensitive member;

a charging member;

an exposure means;

a developing means; and a transfer means, wherein said charging member includes a support and at least one cover layer provided on said support, wherein said cover layer of said charging member includes an outermost layer positioned at an outermost surface of the charging member, wherein said outermost layer contains (i) composite particles including first metal oxide particles coated with carbon black, (ii) second metal oxide particles uncoated with carbon black, and (iii) a binder, wherein said second metal oxide particles are insulating metal oxide particles, wherein said composite particles and said second metal oxide particles are in a weight ratio of composite particles to second metal oxide particles in a range of 0.2 to 3.9, wherein an average particle diameter of said composite particles is in a range of 5 nm to 500 nm, and wherein a microhardness of the surface of the charging member is in a range of 53° to 76° .

* * * * *

UNITED STATES PATENT AND TRADEMARK OFFICE

CERTIFICATE OF CORRECTION

PATENT NO. : 7,366,448 B2
APPLICATION NO. : 11/156773
DATED : April 29, 2008
INVENTOR(S) : Tomohito Taniguchi et al.

It is certified that error appears in the above-identified patent and that said Letters Patent is hereby corrected as shown below:

(73) Assignees
Line 3, "Takuba-shi" should read --Takuba--.

(57) ABSTRACT
Line 3, "support.," should read --support.--.

COLUMN 2
Line 18, "can not" should read --cannot--.
Line 37, "wherein;" should read --wherein--.
Line 45, "wherein;" should read --wherein--.
Line 59, "provide" should read --provides--.

COLUMN 3
Line 10, "presence" should read --present--.
Line 28, "low;" should read --curve--.

COLUMN 5
Line 30, "That the" should read --The--.
Line 31, insert --such-- after "means".
Line 35, delete "on".
Line 36, insert --point X-- after "certain".

COLUMN 6
Line 22, "ca" should read --can--.
Line 39, delete "having," and "into" should read --in--.

COLUMN 7
Line 13, "available" should read --(available--.

Signed and Sealed this

First Day of June, 2010

David J. Kappos

David J. Kappos
*Director of the United States Patent and Trademark Office*

COLUMN 8

Line 47, "

(4)

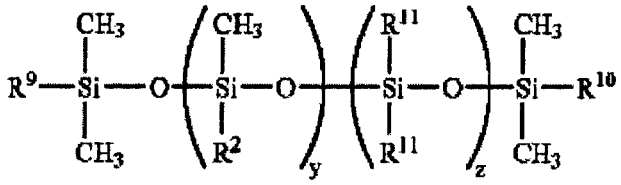

"

$R^9$, $R^{10}$: —OH, $R^{12}$OH, $R^{13}$COOH, ($R^9$ and $R^{10}$ may be the same or different.)
$R^{11}$: —$CH_3$, —$C_6H_5$
$R^{12}$, $R^{13}$: $-(CH_2)_p-$
p: 1~15
y: 1~200
z: 0~100 should read --

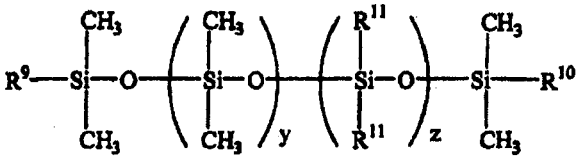

(4)

$R^9$, $R^{10}$: -OH, $R^{12}$OH, $R^{13}$COOH,
($R^9$ and $R^{10}$ may be the same or different.)
$R^{11}$: -$CH_3$, -$C_6H_5$
$R^{12}$, $R^{13}$: $-(CH_2)_p-$
p: 1 ~ 15
y: 1 ~ 200
z: 0 ~ 100

--.

COLUMN 11
Line 46, "preferably in" should read --preferably be in--.
Line 66, "above which" should read --above at which--.
Line 67, "aims at." should read --aims.--.

COLUMN 12
Line 8, "which" should read --at which-- and "aims at." should read --aims.--.
Line 38, delete "(SEBC)".
Line 39, delete "(CEBC)".

COLUMN 15
Line 23, "smoothen" should read --smooth--.
Line 24, "smooth" should be deleted.
Line 26, "any state of" should be deleted, and "slip less" should read --slip,--.
Line 27, "occur" should be deleted.
Line 63, "(ethylele" should read --(ethylene--.

COLUMN 16
Line 20, “layer” should read --layer.--.
Line 21, “have a high electrical resistance value on the contrary.” should be deleted.

COLUMN 20
Line 11, “at 80C” should read --at 80°C--.

COLUMN 21
Line 21, “former’solid” should read --solid--.

COLUMN 22
Line 29, “charged” should read --being charged--.

COLUMN 25
Line 12, “for this was kept” should be deleted.

COLUMN 27
Line 12, “was” should read --were--.
Line 26, “was” should read --were--.

COLUMN 32
Line 11, “particles.” should read --particles,--.
Line 59, delete “chief”.
Line 62, “epichiorohydrin” should read --epichlorohydrin--.

COLUMN 33
Claim 14, line 10, “containing” should read --contains--.
Claim 15, line 21, “member,” should read --member;--.
Line 27, “support;” should read --support,--.

COLUMN 34
Claim 18, line 6, “member,” should read --member;--.